US005806339A

United States Patent [19]

Manley

[11] Patent Number: 5,806,339

[45] Date of Patent: Sep. 15, 1998

[54] MULTIPLE EFFECT AND DISTRIBUTIVE SEPARATION OF ISOBUTANE AND NORMAL BUTANE

[76] Inventor: David B. Manley, 11480 Cedar Grove Rd., Rolla, Mo. 65401

[21] Appl. No.: 628,454

[22] Filed: Apr. 5, 1996

[51] Int. Cl.[6] ..... F25J 3/02

[52] U.S. Cl. ..... 62/631; 62/926

[58] Field of Search ..... 62/620, 630, 631, 62/926

[56] References Cited

U.S. PATENT DOCUMENTS

| | | | |
|---|---|---|---|
| 2,471,134 | 5/1949 | Wright . | |
| 2,952,983 | 9/1960 | Gilmore | 62/631 |
| 3,058,893 | 10/1962 | Cahn et al. . | |
| 3,309,882 | 3/1967 | Cabanaw | 62/631 X |
| 3,313,724 | 4/1967 | Kniel | 62/631 X |
| 4,167,402 | 9/1979 | Davis . | |
| 4,246,073 | 1/1981 | Umeda et al. . | |
| 4,460,396 | 7/1984 | Kaiser et al. . | |
| 4,710,213 | 12/1987 | Sapper et al. | 62/631 |
| 5,152,148 | 10/1992 | Crum et al. | 62/631 |

FOREIGN PATENT DOCUMENTS

| | | | |
|---|---|---|---|
| 1002566 | 8/1965 | United Kingdom | 62/630 |

OTHER PUBLICATIONS

P. C. Wankat, "Multieffect Distillation Processes" (Ind. Eng. Chem. Res., vol. 32, pp. 894–905, 1993).

*Primary Examiner*—Christopher Kilner

[57] ABSTRACT

The present invention is an enhancement of the prior art use of partial effects and component distribution regarding NGL fractionation, especially relating to the separation of propane, isobutane, normal butane and gasoline components. The present invention distributes butanes in two separate columns and integrates the thermodynamic efficiency obtained with partial effects to cascade reboiling duty through as many as four separate columns. The resulting savings in energy are compared with the prior art process of sequential fractionation of NGL.

35 Claims, 13 Drawing Sheets

X ( i-Butane Propane )
Y ( i-Butane Propane )
0.0
0.1
0.2
0.3
0.4
0.5
0.6
0.7
0.8
0.9
1.0

TEMPERATURE F
320
300
280
260
240
220
200
180
160
140
120
100
80
0
25
50
75
100
125
150
175
200
225
250
275
ENTHALPY CHANGE MMBtu/hr

MULTIPLE EFFECT AND DISTRIBUTIVE SEPARATION OF ISOBUTANE AND NORMAL BUTANE

The present invention relates to the fractionation of light hydrocarbons. The present invention especially relates to deisobutanizing and debutanizing.

The article of P. C. Wankat, "Multieffect Distillation Processes" (Ind. Eng. Chem. Res., Volume 32, Pages 894–905, 1993) describes several general concepts on the use of "effects" in fractionation separations. Multiple effect distillation is well known and is commonly employed in air separation and water desalination. The skilled person has learned that multiple effects in fractionation are most likely to result in advantageous application when the boiling range temperature of the mixture is negligible or very small. The reason that this heuristic has developed is as follows.

A basic advantage sought from the "effect" is recovery of condensing duty into reboiling duty with reduction of overall utilities and heat transfer surface (along with associated equipment costs). The requirement that reasonable approach temperatures be maintained in the "cross" exchangers (wherein condensing and reboiling duties are transferred) places on multiple effect systems the following limitation. Such systems rapidly become uneconomical or inoperable when relative volatilities of the components to be separated in adjacent effects are fairly large, such as for components in NGL. As well demonstrated in the prior art, temperature and pressure ranges of multiple effect systems have been found to be extensively applicable for ethane/ethylene, propane/propylene or air separation.

U.S. Pat. Nos. 4,460,596 and 4,460,396 describe a multiple effect separation of ethylene and ethane. U.S. Pat. No. 4,246,073 describes a method of heat integration and component distribution relating to a separation of benzene, toluene and xylenes. U.S. Pat. No. 3,058,893 describes a distributed fractionation of pentanes. U.S. Pat. No. 2,471,134 describes a partitioned column for obtaining a propane product stream as a sidedraw.

Liquid hydrocarbons recovered from natural gas (NGL) are typically separated into relatively pure ethane, propane, isobutane, normal butane, and gasoline products. The purity of these products depends on the usage at the next stage of processing, i.e., fuels usage of one of the products may permit less complete fractionation than for product usage in reaction processes. This recovery of NGL components to a level of commercially desirable purity is presently widely practiced by distilling ethane, propane, and butanes from gasoline in a series sequence, removing the lightest component first followed by the next lightest component until finally removing the butanes before recovering the gasoline fraction. Isobutane and normal butane are typically separated into separate product streams so that they may be directed to various fuels or fuels improvement processes. The final distillation of isobutane from normal butane is energy and capital intensive because the relative volatility of these components is small. Thus, there is need for a method which reduces energy requirements of isobutane and normal butane separation through low capital implementation of thermodynamic efficiency.

SUMMARY OF THE INVENTION

For an NGL feed which has been deethanized and at least partially depropanized, the present invention is a process with a first step comprising a distribution of both isobutane and normal butane to the overhead and bottoms streams of a butanes distributor column, thereby also making a separation of the propane and gasoline in the NGL feed, respectively, to the overhead and bottoms streams. Although both isobutane and butane are recovered to the overhead and bottoms streams, isobutane and butane are partially fractionated from each other in that first step. However, the degree of separation for isobutane and butane is less than that required for making product specification streams of those components from a downstream depropanizer for the overhead stream or from a downstream debutanizer for the bottoms stream. The degree of separation of isobutane and butane in this butanes distributor step interacts with subsequent fractionations of the overhead and bottoms streams as a critical aspect of the present invention.

A second step of the present invention comprises a distribution of normal butane to the overhead and bottoms streams of a normal butane distributor column, thereby also making a separation of the isobutane in the column feed to the overhead stream of the normal butane distributor column. These two steps integrate the separation of the butanes with the depropanizing and debutanizing separations with component distribution and are dramatically improved upon appropriate thermal coupling of the integrated columns.

Generally, thermal coupling, as used herein, is the return of at least a portion of a liquid or vapor stream from a downstream column to an upstream column from which it receives a feed, wherein the feed has no intervening fractionation between the upstream and downstream columns. An example of thermal coupling advantageously used in the present invention are the refluxing of an upstream column with the bottoms liquid stream from a downstream column alone or combination with introducing at least a portion of an overhead or sidedraw vapor stream of the upstream column to the bottom stage of the downstream column to provide reboiling energy to the upstream column. As described below in the specific examples, these butane distributions and appropriately applied thermal couplings of columns result in reductions in size, pieces and cost of equipment with dramatic reductions comparative overall energy input to the deethanization, depropanization, deisobutanization and debutanization of demethanized NGL feed. Additional embodiments of the present invention are described such that the rectification and stripping sections of the columns are advantageously combined or mechanically reconfigured, producing additional reductions in the capital cost of the process.

The feed to the process of the present invention may be a natural gas liquid which has not been depropanized but has been deethanized using either a conventional, high pressure, deethanizer distillation column or a thermally coupled, low pressure deethanizer distillation column. The feed may also comprise a bottoms liquid stream from a low pressure propane distributor column which at least partially depropanizes the natural gas liquid described in the preceding sentence.

An embodiment of the present invention comprises a low pressure normal butane distributor column which uses a relatively low temperature hot utility. A third embodiment of the present invention comprises a comparatively high pressure normal butane distributor column which uses a relatively higher temperature hot utility. The present invention also includes thermal coupling of the normal butane distributor column to a butanes distributor column, depropanizer, debutanizer, deisobutanizer and/or partial effect deisobutanizer to achieve the objects of the present invention.

The present invention also includes an integration, including thermomechanical integration of deethanization stages, of all the sequential, downstream separations of demethanized NGL, including deethanization, depropanization, deisobutanization and debutanization. One embodiment of that thermal coupling comprises removing a vapor sidedraw from the butanes distributor column to supply reboiling vapor to an upstream low pressure deethanizer or propane distributor column, wherein those columns supply a liquid feed stream to the butanes distributor column. Another embodiment of the full integration of the separation sequences comprises withdrawing from a depropanizer thermally coupled with the butanes distributor column and/or the normal butane distributor column a portion of the overhead vapor product to the bottom stage of a set of low pressure deethanization stages. The details of the low pressure deethanizer, propane distribution column and thermomechanical integration of deethanization stages are fully disclosed in a related application described below.

A butanes distributor column may be used to prefractionate an NGL feed to downstream depropanizer and debutanizer columns, thereby improving the thermodynamic efficiency of the separation. The isobutane and normal butane of the feed are partially separated in the butanes distributor column, in addition to the primary separation of propane from gasoline. If the depropanizer and debutanizer columns are vertically thermally coupled (at least a portion of an overhead vapor stream from a first column is introduced to the bottom stage of a second column and at least a portion of the bottoms liquid product from the second column is introduced to the top stage of the first column) producing one sidedraw of mixed butanes from the bottoms stream of the depropanizer (or overhead stream of the debutanizer) for downstream deisobutanizing, the butanes are remixed before withdrawing.

A further improvement of the vertical thermal coupling of the depropanizer and debutanizer of the present invention comprises withdrawing two sidedraws, from separate stages of the vertically thermally coupled depropanizer and debutanizer, preferably withdrawing a single sidedraw from both depropanizer and debutanizer. The butanes are not remixed on the fractionation stages of the vertically thermally coupled columns. The two sidedraw streams then comprise separate feed streams of different composition which are preferably introduced to separate stages of deisobutanization stages. This two-sidedraw embodiment of vertically thermally coupled columns (or two-sidedraw embodiment of a single pressure shell column in which the depropanizer and debutanizer stages are combined) reduces the diameter and reboiler duty of the deisobutanization stages. Alternatively, the depropanizer and debutanizer will comprise separate columns without thermal coupling, i.e., conventionally comprising an overhead condenser and a bottoms reboiler, and will produce, respectively as bottoms and overhead streams, two mixed butanes streams of different composition preferably for introduction to separate stages to the deisobutanization stages.

The present invention also comprises the use of parallel and/or series thermal coupling and partial effect deisobutanization to cascade a single, relatively low temperature heat input at a reboiler through two to four sets of fractionation stages. The elimination of equipment and reduction in energy is dramatic over the conventional processes described below.

The present invention also comprises a two-column, partial effect deisobutanization for a stream consisting essentially of iso- and normal butane.

DETAILED DESCRIPTION OF THE INVENTION

The present invention comprises methods for deisobutanization and further associating deethanization, depropanization and debutanization fractionations in other embodiments.

EXAMPLE 1

Partial Effect Deisobutanizer

It has been discovered that a two effect deisobutanizer, with one effect only making a partial separation in order to balance the energy loads of the columns, significantly reduces the energy consumption of an NGL fractionation plant with relatively little additional investment cost.

Figure 1A:
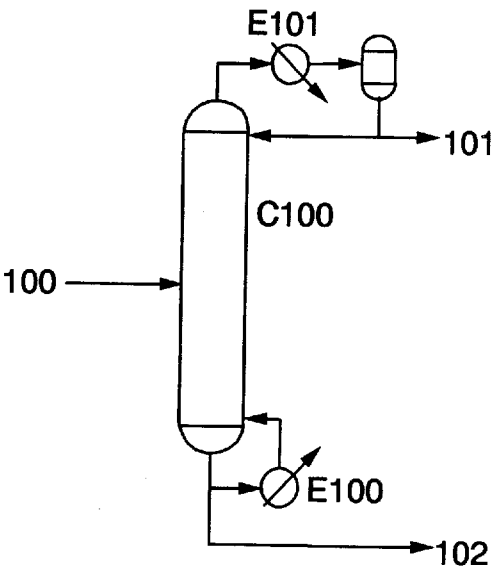
Figure 1A Prior Art
FIG. 1A is a prior art deisobutanizer.

FIG. 1A shows a conventional deisobutanizer for separating isobutane from normal butane, according to typical product specifications for those products. The feed is a natural gas liquid (NGL) from which methane, ethane and propane are reduced to levels then permitting recovery of isobutane and butane at a desired purity. Substantially no gasoline (defined herein as substantially C5 and heavier components with small amounts of iso- and/or normal butane for vapor pressure maximization) has been previously removed from the NGL feed to the deisobutanizer shown in FIG. 1A.

Table 1 gives compositions and conditions for the relevant streams.

| Stream No. | Stream Description |
|---|---|
| 100 | liquid mixed butanes recovered from NGL |
| 101 | overhead liquid product from deisobutanizer, column C100 |
| 102 | bottoms liquid product from column C100 |

In FIG. 1, the deisobutanizer, column C100 with about 58 theoretical stages and a feed stage at about 32 stages from the top stage, produces an overhead vapor stream which is condensed in a condenser, exchanger E101, to provide reflux to column C100 (duty=85.38 MMBtu/hr). Exchanger E100 is a reboiler using hot utility to reboil column C100 (duty=83.15 MMBtu/hr). As used herein unless otherwise stated, the top stage of a column shall be stage number one and all stages beneath it shall be numbered sequentially from the top stage. Also, the Figures show valves (without designation with names or numbers) which are understood by the skilled person to represent in the processes shown to be significant reductions in pressure, as may be understood by inspection of the relative pressures of the streams and columns described herein.

Column C100 is operated at about 80 psia, so that cooling water can be used to condense the overhead vapor product, isobutane, at about 100° F. in exchanger E101. About 83 MMBtu/hr of hot utility is transferred in exchanger E100 to reboil column C100. Using a common method for calculation of diameters of fractionation columns using sieve trays (which method will be used consistently herein for calculation of column diameters), column C100 is calculated to have a diameter of about 15 feet.

Figure 1B:
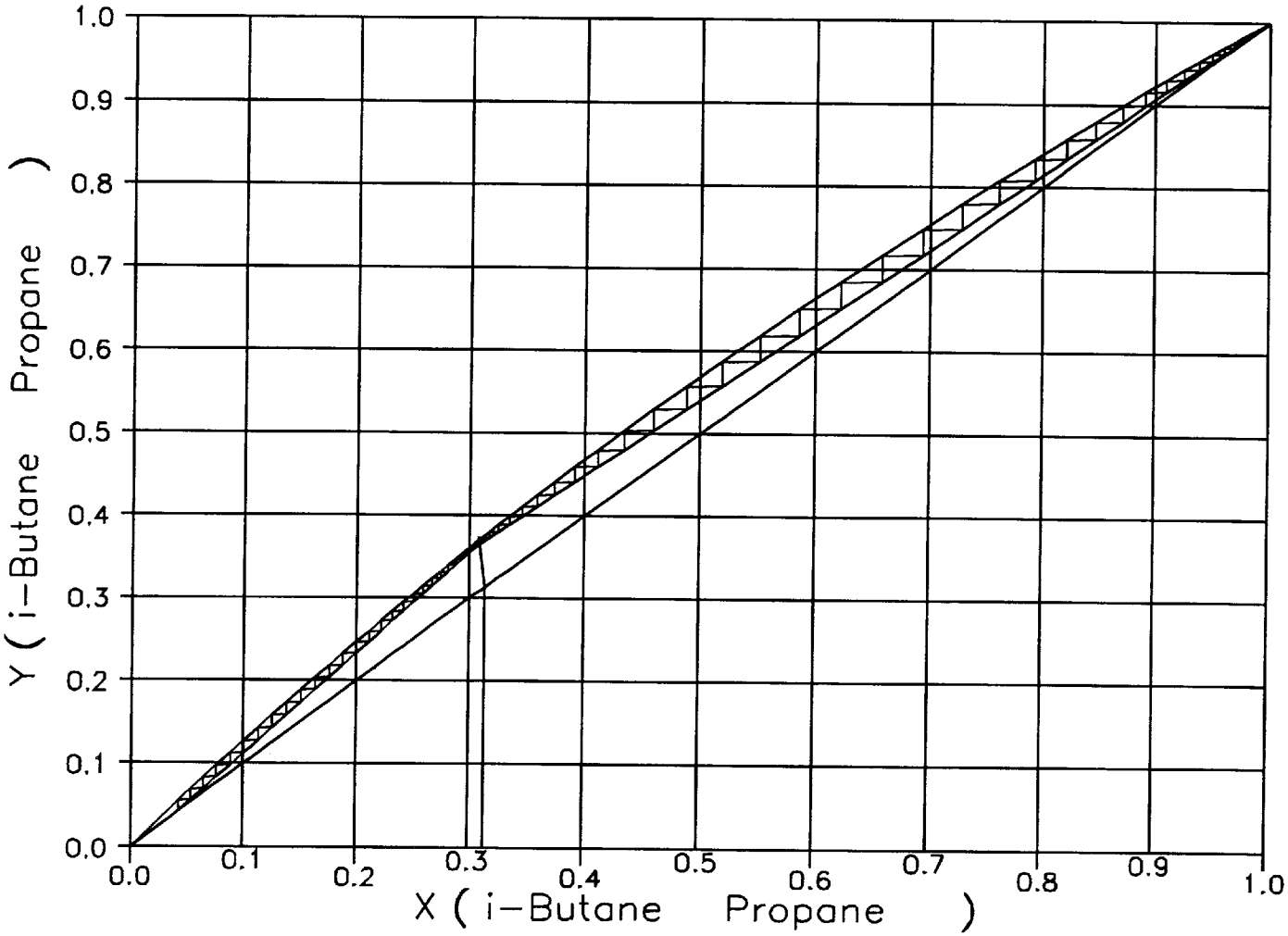
FIGS. 1B and 2B show a McCabe—Thiele diagrams for the conventional and partial effect deisobutanizers with a feed containing about 32 mole percent isobutane. The component plotted in the diagrams is a combined propane/isobutane.

FIG. 1B shows a McCabe—Thiele diagram for the conventional deisobutanizer, shown as column C100 in FIG. 1, with a feed containing about 32 mole percent isobutane. In FIG. 1B, the distance between the operating and equilibrium lines for the rectifying section of column C100 is relatively significantly greater than that of the same distance for the stripping section. This type of analytic comparison of the rectification and stripping sections indicates that the stripping section is operating closer to minimum reflux than the rectification section. Column C100 thereby operates with an inherent limitation.

Figure 1C:
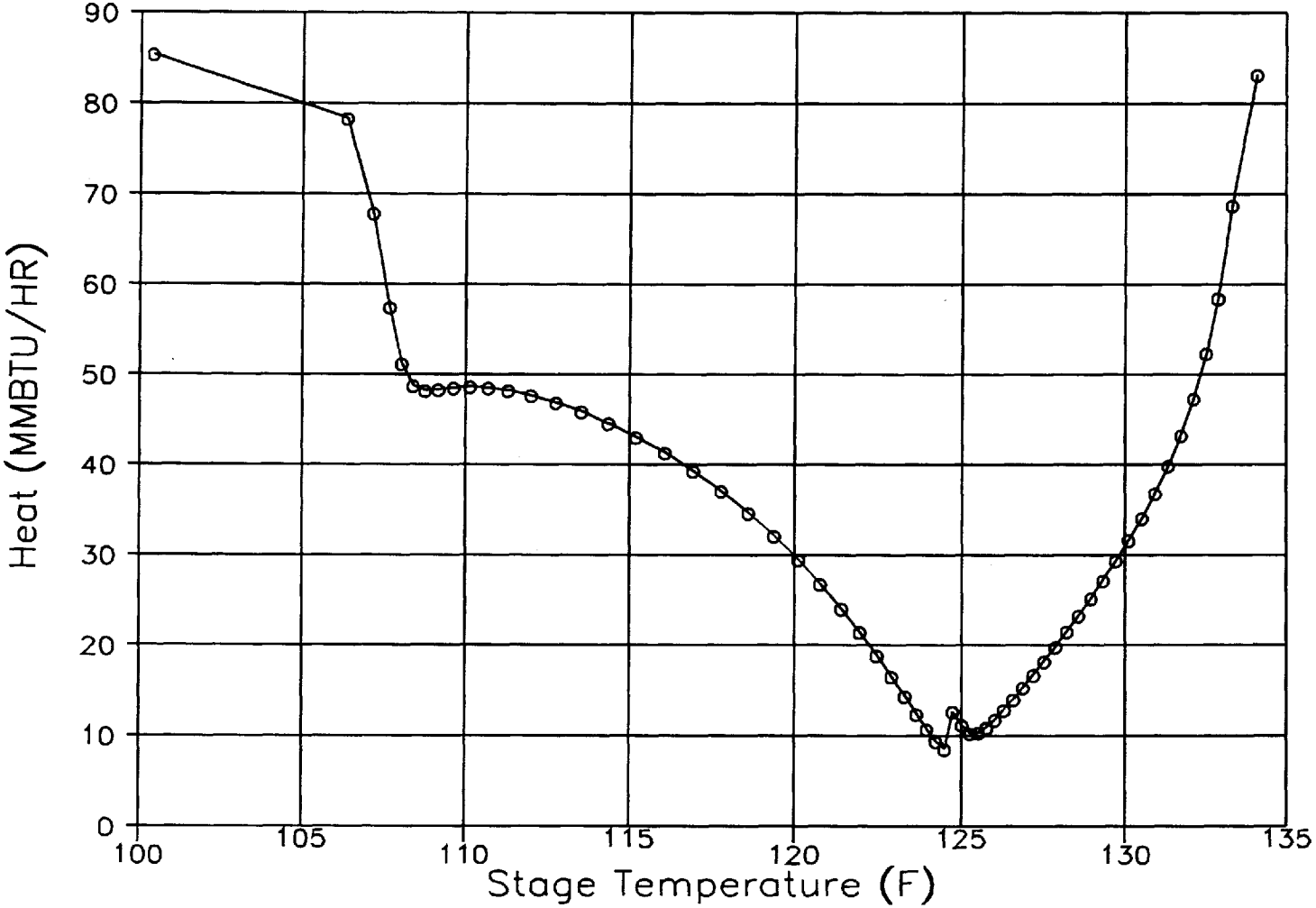
FIGS. 1C, 2C and 2D are column grand composite heating and cooling curves for the columns described in the examples below.

The limitation is graphically illustrated in FIG. 1C, a column grand composite heating and cooling curve for column C100. A column grand composite heating and cooling curve, as used herein, is a plot of the temperature of each fractionation stage of a column (including any associated condenser, as a top, lowest temperature stage, and/or associated reboiler, as a bottom, highest temperature stage) against the rate of heat transfer at the fractionation stage. To the present inventor, FIG. 1C indicates that an intercondenser located at about stage 20 (or about 115° F.) could remove at least about 40 MMBtu/hr from column C100 and provide reflux to it. The overhead condenser, exchanger E101, would thereby be smaller, require less heat transfer and supply less reflux. This thermodynamic improvement, however, would only reduce cooling water consumption at increased capital cost and is not economical. Conceptualization of applications of thermodynamic efficiency to fractionation sequences has been limited by the relatively common experience that thermodynamic efficiency usually translates into uneconomically high capital cost.

EXAMPLE 2

Figure 2A:
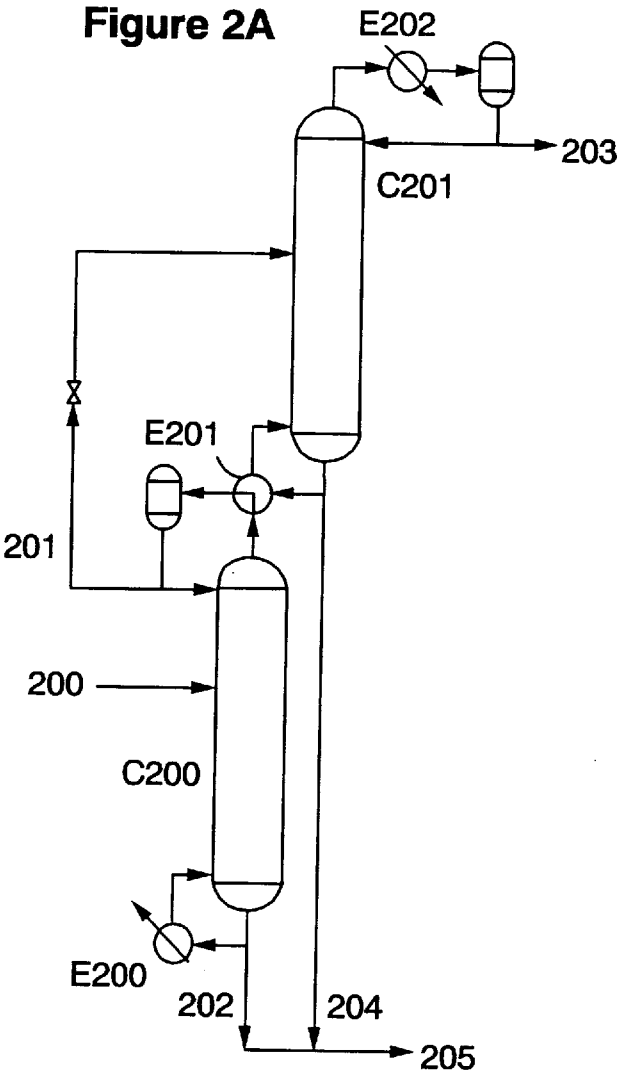
FIG. 2A is a deisobutanization system using a partial effect with two columns.

Thermodynamic Balancing by Feed Component Control to a Partial Effect Deisobutanizer and a Downstream Deisobutanizer FIG. 2A shows a second column, column C201, which operates as a deisobutanizer. As used herein, the term "deisobutanizer" shall refer to a set of stages in a pressure shell whose overhead product stream, which may be vapor or liquid, directly or indirectly meets product specification requirements for isobutane. A product specification can be met indirectly by mixing two or more streams, at least one of which contains impurities greater than product specifications permit and another which has impurities sufficiently below product specifications so that their mixture meets those specifications. The feed for the deisobutanizer is the overhead liquid product of a first column, a partial effect deisobutanizer. The condenser of the first column is cooled in the reboiler of the second column. Table 2 gives the component flows and conditions for the following streams:

| Stream No. | Stream Description |
|---|---|
| 200 | liquid mixed butanes from NGL |
| 201 | overhead liquid product from first deisobutanizer, column C200 |
| 202 | bottoms liquid product from column C200 |
| 203 | overhead liquid product from second deisobutanizer, column C201 |
| 204 | bottoms liquid product from column C201 |

In FIG. 2, the partial effect deisobutanizer, column C200, operating at about 120 psia with 37 theoretical stages and a feed stage at stage 8, produces an overhead vapor stream, which is condensed in a condenser, exchanger E201 (duty=53.32 MMBtu/hr), to provide reflux to column C200. An overhead liquid product, stream 201, is fed to column C201, a deisobutanizer. Exchanger E200 (duty=53.18 MMBtu/hr) reboils column C200 with hot utility, which in turn indirectly supplies reboiling energy to column C201.

Column C201 operates at about 80 psia, has about 58 theoretical stages and a feed stage at stage 23. The overhead vapor stream from column C201 is totally condensed in exchanger E202 (duty=54.99) to form an isobutane overhead liquid product stream, stream 203.

Stream 201 comprises about 50% isobutane. This control of relative amounts of isobutane and normal butane to the deisobutanizer, column C201, produces an important result. The downstream, low pressure, deisobutanizer column is much better balanced thermodynamically. The thermodynamic imbalance graphically shown for the prior art deisobutanizer in FIG. 1A is corrected with the present invention's deisobutanizer component distribution between a partial effect deisobutanizer and the downstream deisobutanizer.

The combined result of improved thermodynamic efficiency and multieffect cascading of heat reduces the total hot utility requirement to about 52 MMBtu/hr or 37% over the conventional design described for example 1. The first, partial effect, deisobutanizer, column C200, has a diameter of about 11 feet. The second, low pressure, deisobutanizer, column C201, has a diameter of about 12 feet. These reductions in diameter over the conventional case contribute to the cost effectiveness of the process.

Figure 2B:
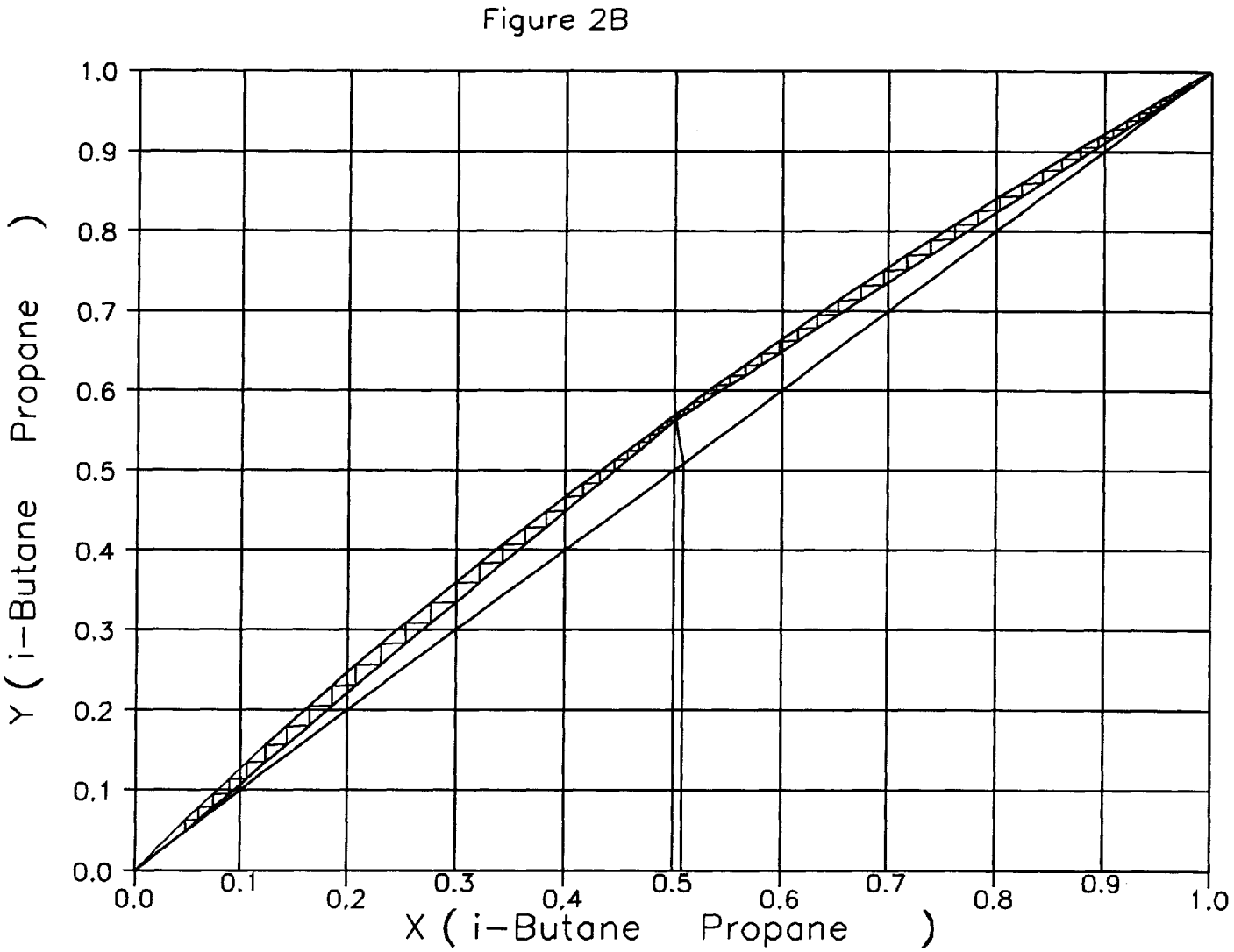
Figure 2C:
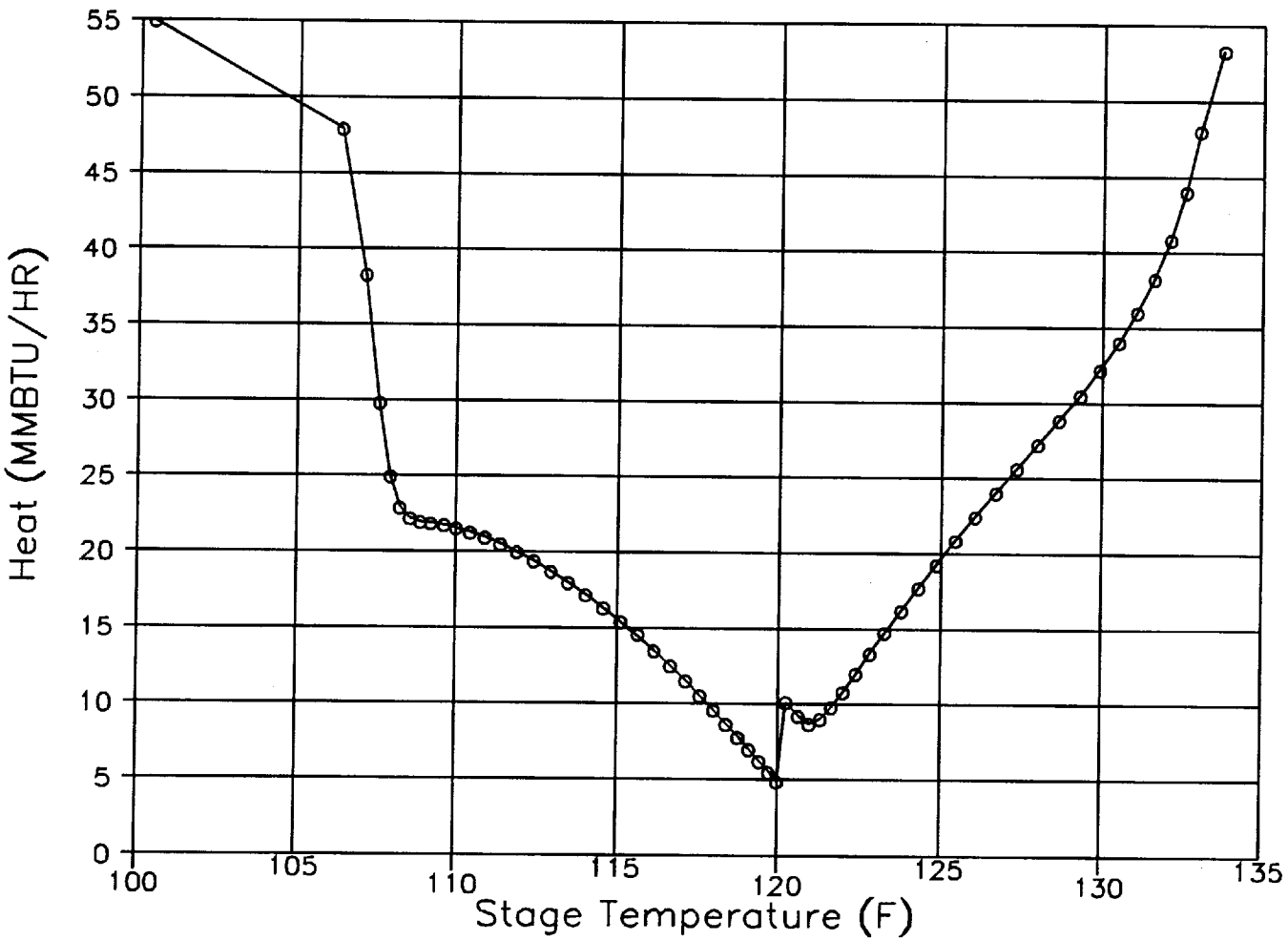
Figure 2D:
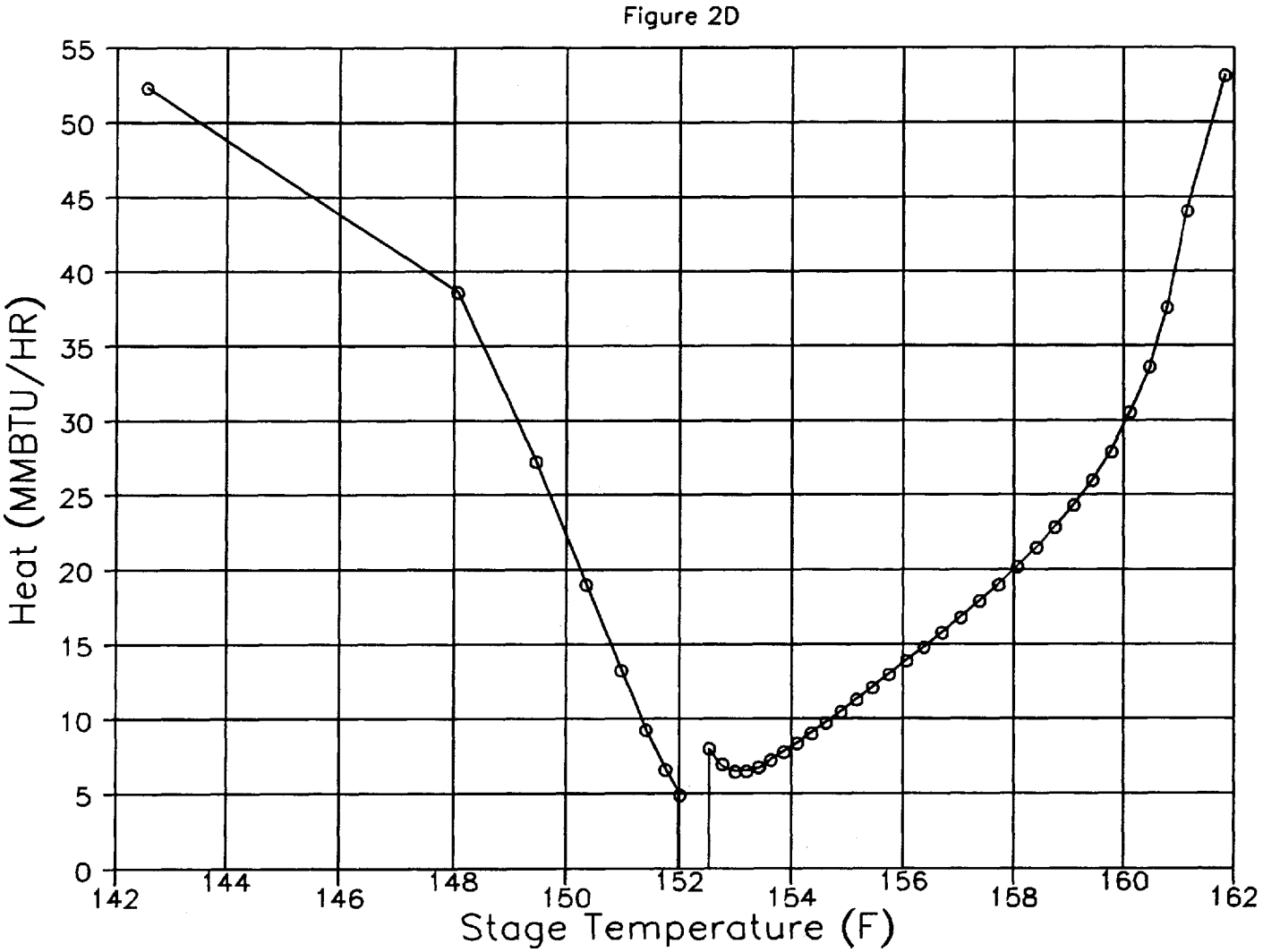

FIG. 2B shows a McCabe—Thiele diagram for the deisobutanizer, column C201, graphically showing the improvement in thermodynamic balance between the stripping and rectifying sections of the deisobutanizer. Further graphical confirmation of the benefits obtained by thermodynamic balancing of the deisobutanizer is shown in FIG. 2C, grand composite heating and cooling curve for column C201. Comparison of FIGS. 1C and 2C indicate a more balanced FIG. 2D shows the grand composite heating and cooling curve for the first, partial effect deisobutanizer, column C200, which is also thermodynamically balanced. The first, partial effect deisobutanizer effectively unloads the stripping section of the second, low pressure, deisobutanizer, allowing more efficient design and operation in comparison with the conventional design of example 1.

The reboiler temperature in exchanger E200 is considerably lower than the reboiler temperature (i.e., such as exchanger E200) for a conventional double effect deisobutanizer with feed splitting (i.e., such as feeding part of stream 200 one column and the rest to another column). The feed splitting in the prior art was done to accomplish what the present invention does more cost effectively—balance the interexchanger duties so that they are effectively matched. The superiority of the present invention over the prior art, split-feed deisobutanization stages becomes particularly apparent when the reboiler duty of the higher pressure, partial effect deisobutanizer column coupled to the condensing duty of an upstream debutanizer condenser, wherein the debutanizer is operated at an even higher pressure. A thermodynamic balancing as described in this example 2 is essential for such an "effect" coupling to a debutanizer, since the pressure and temperature of the debutanizer reboiler are be reasonably limited to reduce hot utility costs and thermal degradation of gasoline components.

EXAMPLE 3

Figure 3A:
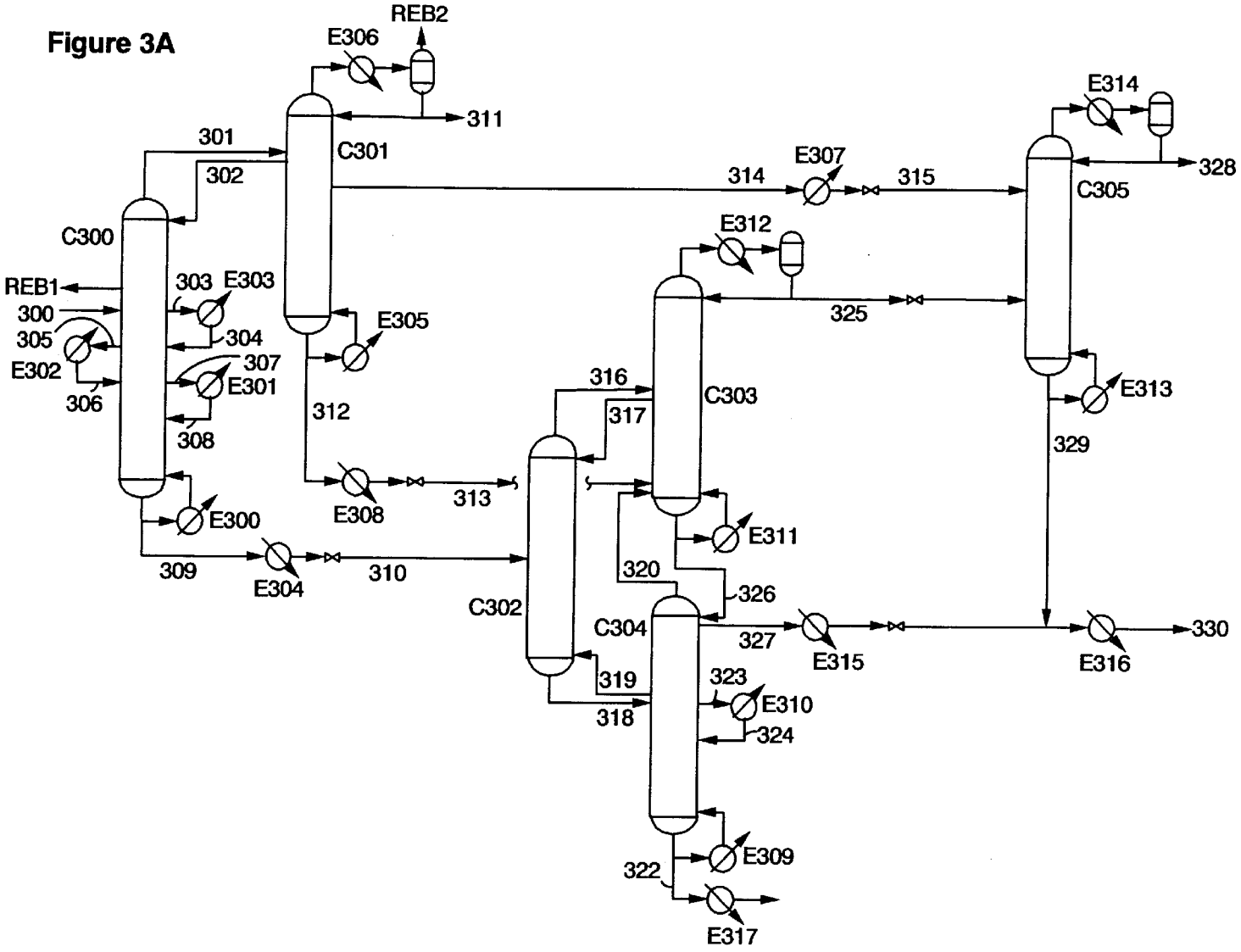
FIG. 3A is a portion of an integrated fractionation sequence for NGL. The portion shown is a full or second partial depropanization, deisobutanization and debutanization of thermally coupled streams from an upstream deethanization and first partial depropanization. The second partial depropanization takes place in a first column and a second column fractionating the overhead vapor stream of the first column. A low pressure normal butane distributor is used.

Distributed Distillation of Butanes in NGL Fractionation/Low Pressure Normal Butane Distributor Process Liquid hydrocarbons recovered from natural gas (NGL) are typically separated into relatively pure ethane, propane, isobutane, normal butane, and gasoline products. This is conventionally done by distilling ethane, propane, and butanes from gasoline in sequence and then distilling isobutane from normal butane. The final distillation of isobutane from normal butane is energy and capital intensive because the relative volatility of these components is small. It has been discovered, as shown in FIG. 3A and described below, that the process may be significantly improved by a novel component distribution among separate columns. These columns, as more fully described below, are called the butanes distributor column and the normal butane distributor distillation column. The result of their operation is a thermally coupling and/or thermodynamically efficient integration of the separation of the butanes with the depropanizing and debutanizing separations. As a result the process energy consumption is significantly reduced. When the rectification and stripping sections of the appropriate columns are combined as described below, the capital cost of the process is also reduced.

The feed to the new process is natural gas liquid which has been deethanized using either a conventional, high pressure, deethanizer distillation column or a set of thermally coupled and/or thermomechanically integrated deethanzation and/or depropanization stages. A related patent application, entitled "Deethanizer/Depropanizer Sequences with Thermal and Thermo-mechanical Coupling and Component Distribution" (filed on Mar. 6, 1996 as Ser. No. / Docket No. 1995. 11_3, and whose inventor is David B. Manley) is hereby incorporated in this application. In that related application, deethanization stages thermally coupled to a depropanizer or to a propane distributor column and with a depropanizer are described.

For the following embodiments of the present invention, appropriately identified streams are received from and transferred to such deethanization stages according to the embodiment of example 6 in the related application. Thermomechanical embodiments of deethanization stages, although a highly efficient method for practicing the present invention, are not a limitation to obtaining the benefits of the present invention. Conventional or typical deethanizers or thermally coupled deethanizers are adaptable to the fractionation sequences of the following examples upon application of skill in the art. As described in example 4 of the related application, a vapor sidedraw is withdrawn from the first fractionation column in the sequence of columns in the following examples and is used to supply stripping, reboiling duty to the bottom of a propane distributor column (or to the deethanization stages of other examples in the related application). Also, as described in example 6 of the related application, a portion of the vapor overhead product of the depropanizer of the examples below is fed to the bottom stage of the deethanization stages to supply stripping, reboiling duty for the low pressure section of the deethanization stages.

In this example, a process embodiment is described with a low pressure normal butane distributor column which uses a relatively low temperature hot utility. Table 3 gives the component flows and conditions for the following streams:

| Stream No. | Stream Description |
|---|---|
| 300 | deethanized and partially depropanized NGL feed with butanes / gasoline from liquid bottoms stream from a propane distributor column (not shown) |
| 301 | vapor overhead stream from butanes distributor column, column C300 (with about 53 stages) to stage 19 of the depropanizer, column C301 with about (78 stages) |
| 302 | liquid sidedraw from column C301 / stage 19 to top stage of column C300 |
| 303 | liquid sidedraw for interreboiling from stage 14 / column C300 |
| 304 | partially vaporized liquid sidedraw return to stage 21 / column C300 |
| 305 | liquid sidedraw for interreboiling from stage 21 / column C300 |
| 306 | partially vaporized liquid sidedraw return to stage 28 / column C300 |
| 307 | liquid sidedraw for interreboiling from stage 28 / column C300 |
| 308 | partially vaporized liquid sidedraw return to stage 35 / column C300 |
| 309 | liquid bottoms product from column C300 |
| 310 | depressed bubble point bottoms liquid product from column C300 |
| 311 | overhead liquid product (propane) from column C301 to propane product stream |
| 312 | liquid bottoms product from column C301 |
| 313 | depressed bubble point liquid bottoms product from column C301 to bottom stage of a partial effect debutanizer, |

-continued

| Stream No. | Stream Description |
|---|---|
| | column C303 (with about 39 stages) |
| 314 | vapor sidedraw stream from stage 34 / column C301 |
| 315 | condensed vapor sidedraw from column C301 to a deisobutanizer, column C305 (with about 58 stages) at stage 25 |
| 316 | vapor overhead stream from n-C4 distributor column, column C302 (with about 44 stages), to column C303 / stage 9 |
| 317 | liquid sidedraw from column C303 / stage 9 to the top stage of column C302 |
| 318 | bottoms liquid product from column C302 to the debutanizer, column C304 (with about 39 stages) at stage 15 |
| 319 | vapor sidedraw stream from column C304 / stage 15 to bottom stage of column C302 |
| 320 | vapor overhead stream from column C304 to the bottom stage of column C303 |
| 322 | bottoms liquid product (gasoline) from column C304 |
| 323 | liquid sidedraw for interreboiling from stage 15 / column C304 |
| 324 | partially vaporized liquid sidedraw return to stage 25 / column C304 |
| 325 | overhead liquid product from column C303 to column C305 / stage 35 |
| 326 | bottoms liquid product from column C303 to top stage of column C304 |
| 327 | liquid sidedraw from top stage of column C304 as portion of n-C4 product stream |
| 328 | overhead liquid product stream (isobutane) from column C305 |
| 329 | bottoms liquid product from column C305 as portion of n-C4 product stream |
| 330 | combined n-C4 liquid product stream |
| REB1 | vapor sidedraw from stage 14 / column C300 to bottom stage of propane distribution column (not shown) or deethanization stages (not shown) |
| REB2 | overhead vapor product from column C301 to bottom stage of deethanization stages (not shown) |

Table 3 also contains the duties of the exchangers shown in FIG. 3A. Those exchangers are exchangers E300 (reboiler for column C300), E301 (bottom interreboiler for column C300), E302 (middle reboiler for column C300), E303 (top interreboiler for column C300), E304 (subcooler for liquid bottom product from column C300), E305 (reboiler for column C301), E306 (overhead condenser for column C301), E307 (condenser for vapor sidedraw from column C301), E308 (subcooler for bottoms liquid product from column C301), E309 (reboiler for column C304), E310 (interreboiler for column C304), E311 (reboiler for column C303), E312 (overhead condenser for column C303), E313 (reboiler for column C305), E314 (overhead condenser for column C305), E315 (subcooler for liquid sidedraw from top stage of column C304), E316 (subcooler for normal butane product stream) and E317 (subcooler for gasoline product stream, from which the relatively high temperature heat is integrated into heat recovery to other process heating steps). The subcooling heat exchangers present opportunities to integrate their cooling duties with heating or reboiling/interreboiling requirements elsewhere in the process, and such integration or inter-exchange will eliminate one of the heat exchangers of the inter-exchange and reduce overall heat input to the processes of the examples 3 to 6.

A deethanized and partially depropanized NGL stream, stream 300, feeds the butanes distributor column, column C300. The vapor sidedraw stream from stage 14, stream REB1, is fed to the bottom stage of a low pressure deethanizer or to a propane distributor column, although the stage location of the sidedraw is preferably within a few stages of the feed stage for column C300. The feed to column C302, stream 310, has been depropanized in column C300, which separates propane in its overhead product, stream 301, from gasoline in its bottoms product, stream 309, while distributing isobutane and normal butane between those overhead and bottoms products. Two types of thermodynamic efficiency improvements are applied to column C300. The first improvement is distribution of iso- and normal butane components in stream 300 to both the overhead and bottoms streams of column C300. The second improvement is a thermal coupling (i.e., return to the top stage of an upstream column a liquid sidedraw from a downstream column) of the butanes distributor column, column C300, with the depropanizer, column C301. An additional thermal coupling of the butanes distributor column through stream REB1 to the bottom of an upstream low pressure deethanizer or propane distributor column reduces the bottoms temperature of the upstream low pressure deethanizer or propane distributor column and consequently reduces the reflux required in the butanes distributor column, column C300.

Column C300 is preferably operated at about 255 psia. The pressure of column C300 is preferably slightly higher than that of column C301 to facilitate the benefits of thermal coupling by exchange of vapor and liquid streams. Column C300 is partially interreboiled in exchangers E301, E302 and E303 to provide energy for the vapor sidedraw, stream REBI, and to minimize the amount hot utility required in its reboiler, exchanger E300. The partial interreboilers, exchangers E301, E302 and E303 are preferably heat integrated with hot streams from elsewhere in the process.

Column C300 is refluxed by recycle liquid in stream 302 from column C301. This thermal coupling through recycle flow raises the overhead vapor stream temperature of column C300 and reduces the reboiler duty of downstream depropanizer column C301. The depropanized bottoms product, stream 309, from C300 is subcooled in exchanger E304 before being fed to the downstream normal butane distributor column, column C302. In addition to its primary function of separating propane from gasoline, column C300 also partially separates the butanes into a relatively isobutane rich net overhead vapor stream and a relatively isobutane lean net bottoms liquid product. This enhances the normal butane recovery in the bottom product from column C302 and significantly contributes to the thermal efficiency of the process.

Column C301 is fed by the gasoline free overhead product from column C300 and separates propane in its overhead product from butanes in its vapor sidedraw product. A stripping section below the vapor sidedraw, stream 314, separates isobutane from the normal butane bottoms product. Column C301 preferably operates at about 250 psia so that its overhead propane product can be totally condensed with cooling water, and a vapor overhead product may be used to reboil upstream deethanization stages (not shown).

The net overhead liquid product, stream 311, of column C301 is typically completely condensed and pumped to battery limits conditions. The mixed butanes vapor side draw stream, stream 314, is condensed and subcooled in exchanger E307. The condensing duty of exchanger E307 is preferably supplied by heat integration with cold process streams. Deisobutanizer column C305 is fed at an upper feed stage with the subcooled mixed butanes stream 315. The normal butane bottoms liquid product, stream 329, is combined with stream 327 and subcooled in exchanger E316. About 56% of the normal butane in the net feed to column C301 is recovered as a stream preferably meeting product specification in stream 312 and need not be further deisobutanized. This contributes significantly to the overall energy efficiency of the process.

The normal butane (n-C4) distributor column, column C302, is fed with stream 310, the bottoms liquid product from column C300. Stream 310 is subcooled in exchanger E304 with all the net gasoline feed components fed to column C300 in stream 300. In addition, stream 310 contains substantial amounts of the isobutane (i-C4) and normal butane from the net feed stream to column C300. Column C302 separates all the isobutane in its feed, stream 310, to its overhead vapor stream, stream 316. Column C302 further separates all the gasoline in its feed, stream 310, to the liquid bottoms product, stream 318, while distributing normal butane between the overhead and bottoms products.

As an aid to appreciate the operation of column C302, consider that the feed to that column is a mixture of NGL butanes and gasoline which has been previously deethanized, depropanized and partially debutanized. As described above, the feed stream, stream 310, has been cooled to approximately its bubble point temperature. Column C302 operates at about 125 psia and is refluxed by recycle liquid from column C303. The reflux liquid stream is stream 317 and is preferably drawn from a stage near the feed stage for column C303. Column C303 is preferably reboiled by recycle vapor from downstream debutanizing column C304. The reboiling vapor stream is stream 319 and is preferably drawn from a stage near the feed stage of column C304. This refluxing and reboiling by recycle streams raises and lowers the overhead and bottoms temperatures of column C302 respectively and consequently reduces the reboiling and condensing duties of downstream columns C303 and C304 respectively. About 29% of the normal butane in the feed to column C302 is recovered in the bottoms liquid product, stream 318. This contributes significantly to the energy efficiency of the process.

Column C304 separates normal butane to stream 327 from gasoline to its bottoms liquid product, stream 322. Column C304 operates at about 125 psia so that a vapor sidedraw on or near the feed stage may be used to reboil column C302. The additional energy for generating the vapor sidedraw from column C304 is provided by a partial interreboiler, exchanger E310, which is heat integrated with hot streams from elsewhere in the process. Column C304 is refluxed by recycle liquid normal butane from column C303. This refluxing by recycle flow eliminates the need for a reboiler/condenser thermally coupling columns C303 and C304, and eliminates the associated thermal driving force which would be necessary to operate the reboiler/condenser. As a result, the reboiler pressure and temperature of column C304 are minimized at about 128 psia and about 260° F. respectively, and very low pressure steam may be used to drive the reboiler. The gasoline bottoms liquid product, stream 322 is preferably cooled by heat integration with cold streams from elsewhere in the process and is pumped to battery limits conditions.

Partial effect deisobutanizing column, column C303 produces an overhead liquid product, stream 325 of approximately 50/50 mixture of isobutane and normal butane. The bottoms liquid product preferably comprises product specification normal butane. Column C303 operates at about 125 psia so that a liquid sidedraw on or near the feed stage may be used to reflux column C302, and so that the vapor normal butane overhead product from column C304 may be used to supply most of the column C303 reboil vapor, in addition to that supplied from reboiler E311. The relative amounts of the butanes in the overhead liquid product of column C303 is chosen so that only a small net reboiler duty must be supplied to column C303, and so that the overhead condenser duty in exchanger E312 is only slightly greater than the required reboiler duty for column C305.

Matching or exceeding the reboiler duty of exchanger E313, the column C305 reboiler, with the condensing duty of exchanger E312, the column C303 condenser, permits the use of a single interexchanger so that the condensing duty of column C303 supplies all the reboiling duty of column C305. The skilled person will understand with this disclosure that the disclosed relative butanes composition of stream 325 may be advantageously manipulated to obtain favorable approach temperatures between the condensing overhead vapor stream of column C303 and the required reboiling temperature of column C305.

The rather remarkable result of this partial effect debutanization in column C303 and column C305 is that the partial effect deisobutanization is a final connection linking the downward, temperature-wise cascading of reboiling from a relatively low temperature heat source in exchanger E309 through parallel columns, columns C304 and C302, through an interexchanger E312/E313, through column C305 and finally being condensed by exchanger E314. In further explanation, this novel configuration allows virtually all the reboiling energy supplied to column C304 to be reused twice as it cascades through columns C302 and C303 in parallel and through column C305 in series. The net liquid normal butane bottoms product from column C305 is preferably cooled by heat integration in exchanger E316 with cold streams from elsewhere in the process, is combined with cooled normal butane bottoms product from downstream low pressure deisobutanizer column C305, and is pumped to battery limits conditions. About 50% of the normal butane in the net feed to column C303 is recovered in stream 327 and need not be further deisobutanized.

Low pressure deisobutanizer column, column C305 separates isobutane in its overhead product from normal butane in its bottoms product. Column C305 operates at about 80 psia so that cooling water may be used as a heat sink in its condenser, exchanger E314, and so that its reboiler temperature is low enough so that the duty for exchanger E313 may be obtained by interexchange with the condensing duty of exchanger E312. Column C305 is fed by the approximately 50/50 mixture of isobutane and normal butane in stream 325, the overhead product from column C303 and by stream 315, a mixed butanes sidedraw stream from column C301, containing about 60% isobutane, which has been subcooled before flashing to column pressure. Stream 329, the normal butane bottoms liquid product from column C305, is combined with cooled stream 327, is cooled by heat integration with cold streams from elsewhere in the process, and is pumped to battery limits conditions. The isobutane overhead product from column C305 is typically subcooled and pumped to battery limits conditions.

Figure 3B:
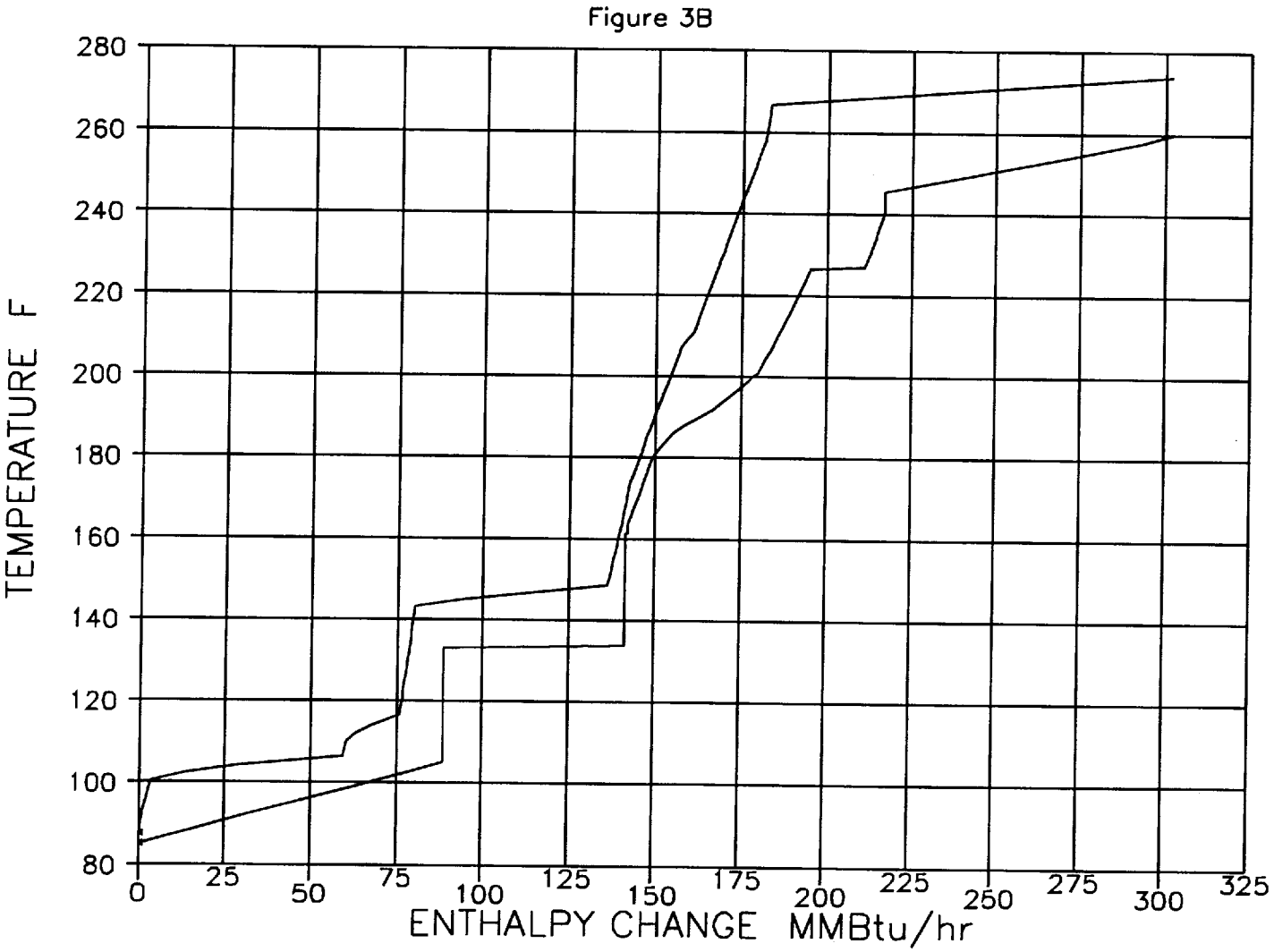
FIGS. 3B and 5B are process composite heating and cooling curves for the examples 3 and 5 described below.

FIG. 3B shows process composite heating and cooling curves for the process shown FIG. 3A. About 29 MBtu/bbl of feed very low pressure steam (30 psig) hot utility are required. This is a dramatic improvement over conventional processes which may require more than twice this amount to accomplish the same objectives.

EXAMPLE 4

Figure 4:
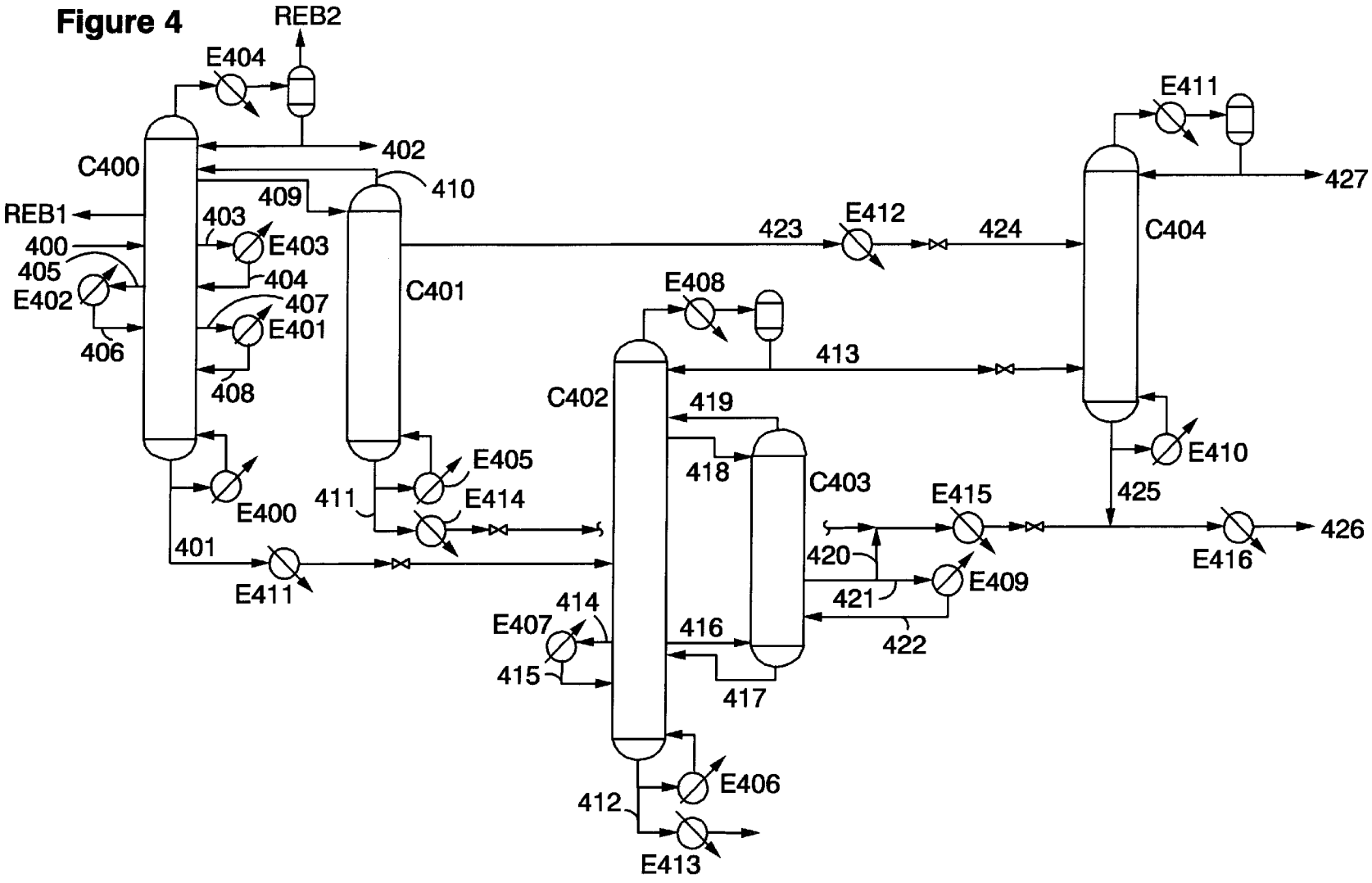
FIG. 4 is a portion of an integrated fractionation sequence for NGL. The portion shown is a partial depropanization, deisobutanization and debutanization of thermally coupled streams from an upstream deethanization and partial depropanization. The process shown in FIG. 3A is effectively reproduced with an alternate configuration of the location of fractionation stages in the several pressure shells of the columns shown in FIG. 4.

Mechanical Reconfiguration of Distributed Distillation of Butanes in NGL Fractionation/Low Pressure Normal Butane Distributor Process FIG. 4 shows a mechanical reconfiguration of the distillation column rectifying and stripping sections of the columns shown in FIG. 3A. The elimination of some pressure shells for separations in the columns shown in FIG. 3A results in a significant reduction in cost for the process described in example 3. The following streams are described with reference to their analogs in the streams described in example 3:

| Stream No. | Stream Description |
|---|---|
| 400 | (stream 300) deethanized and partially depropanized NGL feed with butanes / gasoline from liquid bottoms stream from a propane distributor column (not shown) |
| 401 | (stream 309) liquid bottoms product from depropanizer, column C400 (with about 68 stages) |
| 402 | (stream 311) liquid overhead product from column C400 |
| 403 | (stream 303) liquid sidedraw for interreboiling from stage 28 / column C400 |
| 404 | (stream 304) partially vaporized liquid sidedraw return to stage 35 / column C400 |
| 405 | (stream 305) liquid sidedraw for interreboiling from stage 35 / column C400 |
| 406 | (stream 306) partially vaporized liquid sidedraw return to stage 42 / column C400 |
| 407 | (stream 307) liquid sidedraw for interreboiling from stage 42 / column C400 |
| 408 | (stream 308) partially vaporized liquid sidedraw return to stage 49 / column C400 |
| 409 | liquid sidedraw from column C400 / stage 14 to top stage of sidestripper, column C400 (with about 65 stages) |
| 410 | vapor overhead stream from column C401 to column C400 / stage 14 |
| 411 | (stream 312) bottoms liquid product (normal butane) from column C401 |
| 412 | (stream 322) bottoms liquid product (gasoline) from column C402 |
| 413 | (stream 325) overhead liquid product from column C402 to a deisobutanizer, column C405 (with about 58 stages) at stage 35 |
| 414 | (stream 323) liquid sidedraw for partial interreboiling, column C402 (with about 77 stages) at stage 53 |
| 415 | (stream 324) partially vaporized liquid sidedraw return to column C404 / stage 63 |
| 416 | vapor sidedraw stream from column C402 / stage 53 to bottom stage of column C403 |
| 417 | bottoms liquid product from a thermally coupled column, column C403 (with about 34 stages), to column C402 / stage 53 |
| 418 | liquid sidedraw from column C402 / stage 8 to the top stage of column C403 |
| 419 | vapor overhead stream from column C403 to column C402 / stage 8 |
| 420 | liquid sidedraw (normal butane) from column C403 / stage 30 to normal butane product |
| 421 | liquid sidedraw for interreboiling from column C403 / stage 30 |
| 422 | partially vaporized liquid sidedraw return to column C403 / stage 30 |
| 423 | vapor sidedraw from column C401 / stage 20 |
| 424 | condensed vapor sidedraw from column C401 to column C404 / stage 25 |
| 425 | bottoms liquid product from column C405 as portion of normal butane product stream |
| 426 | combined n-C4 liquid product stream |
| 427 | liquid sidedraw from top stage of column C404 as isobutane product |
| REB1 | vapor sidedraw from stage 28 / column C400 to bottom stage of propane distribution column (not shown) or low pressure deethanization stages (not shown) |
| REB2 | overhead vapor product from column C401 to bottom stage of low pressure deethanization stages (not shown) |

The heat exchangers shown in FIG. 4 are exchangers E400 (reboiler for column C400), E401 (bottom interreboiler for column C400), E402 (middle reboiler for column C400), E403 (top interreboiler for column C400), E404 (condenser for column C400), E405 (reboiler for column C401), E406 (reboiler for column C402), E407 (interreboiler for column C402), E408 (condenser for column C402), E409 (interreboiler for column C403), E410 (reboiler for column C404), E411 (overhead condenser for column C404), E412 (condenser for vapor sidedraw from column C401), E413 (subcooler for gasoline product stream, from which the relatively high temperature heat is integrated into heat recovery to other process heating steps), E414 (subcooler for bottoms liquid product from column C401), E415 (subcooler for normal butane product from columns C401 and C403), and E416 (subcooler for combined normal butane product stream).

Further identifying the analogs of example 3/ FIG. 3A and example 4/ FIG. 4, the rectifying section of depropanizer column C301 is about the same diameter as the normal butane distributor column C300, and are thus stacked to form column C400. The smaller diameter, relatively tall, depropanizer stripping section from column C301 is made a side stripper as column C401. For similar reasons the rectifying section of column C303, the entire column C302, and the stripping section of column C304 are combined into one tall column of approximately uniform diameter as column C402. The stripping section of column C303 and the rectifying section of column C304 are about the same diameter and are combined into a separate, thermally coupled, column, column C403. The two thermally coupled columns may be combined into one vertically partitioned column although this is not shown in FIG. 4. Column C305 remains as a stand alone column as column C404. Thus the six, nonuniform columns of FIG. 3A are reconfigured into four or five columns of relatively uniform diameter in FIG. 4 and capital costs are significantly reduced.

EXAMPLE 5

High Pressure Normal Butane Distributor Process

Figure 5A:
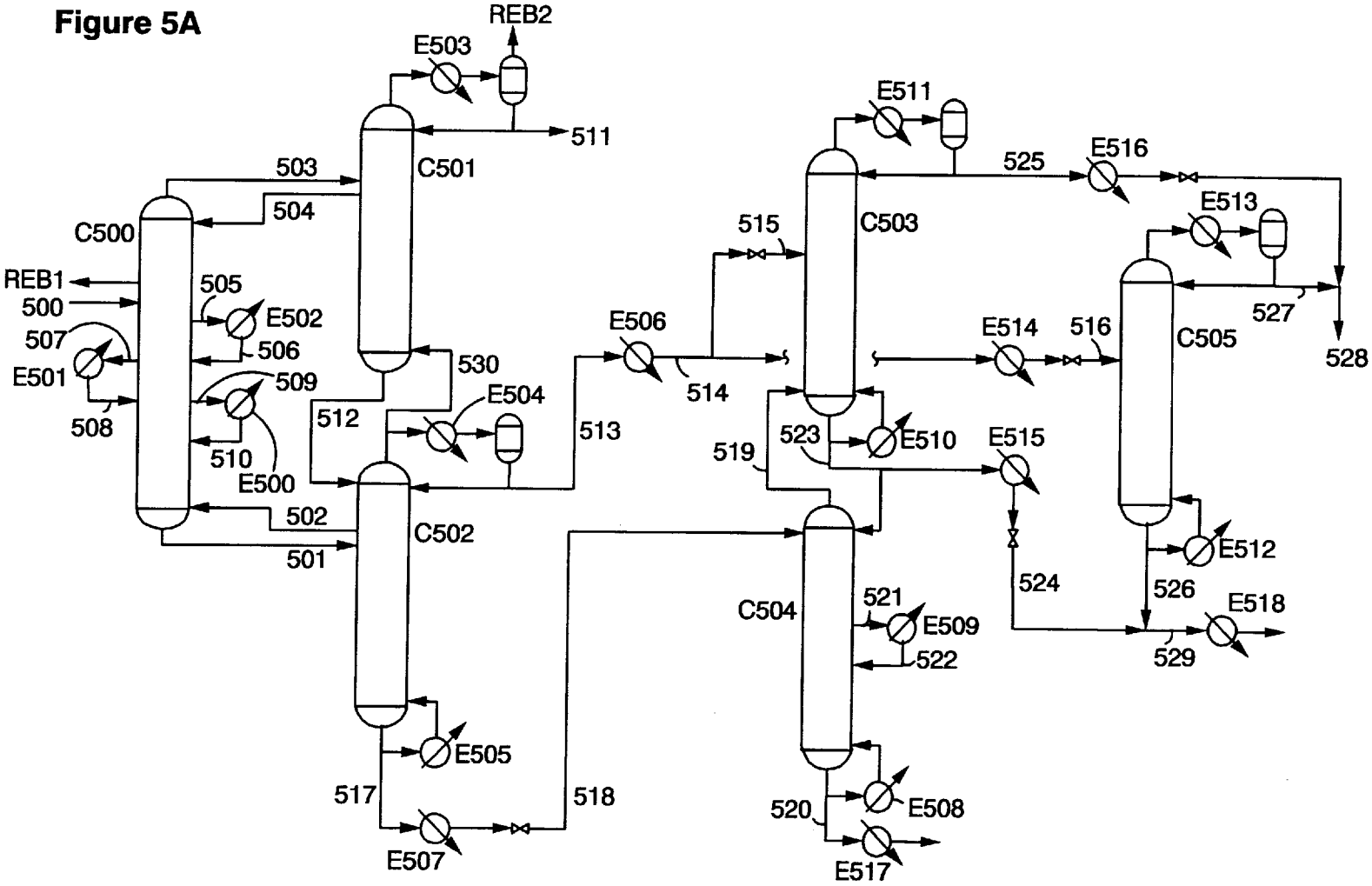
FIG. 5A is a portion of an integrated fractionation sequence for deethanized or partially depropanized NGL. The portion shown is a partial depropanization, deisobutanization and debutanization of thermally coupled streams from an upstream deethanization and partial depropanization. A high pressure normal butane distributor is used.

FIG. 5A shows a normal butane distributor distillation column, C502, which separates isobutane in its overhead product from gasoline in its bottoms product while distributing normal butane between the overhead and bottoms products. Table 5 contains conditions and compositions for the streams shown in FIG. 5A and described as follows:

| Stream No. | Stream Description |
|---|---|
| 500 | deethanized and partially depropanized NGL feed with butanes / gasoline from liquid bottoms stream from a propane distributor column (not shown) |
| 501 | bottoms liquid product from butanes distributor column, column C500 (with about 54 stages) to stage 19 of a normal butanes distributor column, column C502 (with about 58 stages). |
| 502 | vapor sidedraw from column C502 / stage 19 to bottom stage of column C500 |
| 503 | overhead vapor stream from column C500 to depropanizer, column C501 (with about 35 stages), at stage 14 |
| 504 | liquid sidedraw from column C501 / stage 14 to top stage of column C500 |
| 505 | liquid sidedraw for interreboiling from stage 14 / column C500 |
| 506 | partially vaporized liquid sidedraw return to stage 21 / column C500 |
| 507 | liquid sidedraw for interreboiling from stage 21 / column C500 |
| 508 | partially vaporized liquid sidedraw return |

-continued

| Stream No. | Stream Description |
|---|---|
| | to stage 28 / column C500 |
| 509 | liquid sidedraw for interreboiling from stage 28 / column C500 |
| 510 | partially vaporized liquid sidedraw return to stage 35 / column C500 |
| 511 | overhead liquid product (propane) from column C501 to propane product stream |
| 512 | liquid bottoms product from column C501 to top stage of column C502 |
| 513 | overhead liquid product from column C502 |
| 514 | subcooled overhead liquid product from column C502 |
| 515 | portion of stream 514 to a first deisobutanizer, column C503 (with about 69 stages) at stage 38 |
| 516 | partly vaporized portion of stream 514 to a second deisobutanizer, column C505 (with about 53 stages), at stage 31 |
| 517 | bottoms liquid product from column C502 |
| 518 | subcooled bottoms liquid product from column C502 to debutanizer, column C504 (with about 44 stages) at stage 24 |
| 519 | vapor overhead stream from column C504 to the bottom stage of column C503 |
| 520 | bottoms liquid product (gasoline) from column C504 |
| 521 | liquid sidedraw for interreboiling from stage 32 / column C504 |
| 522 | partially vaporized liquid sidedraw return to stage 32 / column C504 |
| 523 | bottoms liquid product from column C503, a portion of which is fed to the top stage of column C504 |
| 524 | non-reflux portion of bottoms liquid product from column C503, subcooled and comprising normal butane product |
| 525 | overhead liquid product from column C503 to isobutane product stream |
| 526 | bottoms liquid product from column C505 to normal butane product stream |
| 527 | overhead liquid product from column C505 to isobutane product stream |
| 528 | combined liquid product stream (isobutane) from columns C503 and C505 |
| 529 | combined liquid product stream (normal butane) from columns C503 and C505 |
| 530 | portion of overhead vapor product stream from column C502 to bottom stage of column C501 |
| REB1 | vapor sidedraw from stage 14 / column C500 to bottom stage of propane distribution column (not shown) or low pressure deethanization stages (not shown) |
| REB2 | overhead vapor product from column C501 to bottom stage of low pressure deethanization stages (not shown) |

Table 5 also contains the duties of the exchangers shown in FIG. 5A. Those exchangers are exchangers E500 (bottom interreboiler for column C500), E501 (middle interreboiler for column C500), E502 (top interreboiler for column C500), E503 (overhead condenser for column C501), E504 (overhead condenser for column C502), E505 (reboiler for column C502), E506 (subcooler for overhead liquid product form column C502), E507 (subcooler for bottoms liquid product from column C502), E508 (reboiler for column C504), E509 (interreboiler for column C504), E510 (reboiler for column C503), E511 (overhead condenser for column C503), E512 (reboiler for column C505), E513 (condenser for column C505), E514 (subcooler for feed to column C505), E515 (subcooler for normal butane bottoms liquid product from column C503), E517 (subcooler for gasoline product stream, from which the relatively high temperature heat is integrated into heat recovery to other process heating steps), and E518 (subcooler for combined normal butane product stream).

A deethanized and partially depropanized NGL stream, stream 500, feeds the butanes distributor column, column C500. The vapor sidedraw stream from stage 14, stream REB1, is fed to the bottom stage of a low pressure deethanizer or to a propane distributor column, although the stage location of the sidedraw is preferably within a few stages of the feed stage for column C500.

Three thermodynamic efficiency improvements are applied to column C500 and the columns that receive its process streams. The first improvement is distribution of at least a part of the iso- and normal butane components in stream 500 to both the overhead and bottoms streams of column C500. The second improvement is a thermal coupling (i.e., return to the top stage of an upstream column a liquid sidedraw from a downstream column) of the butanes distributor column, column C500, with the depropanizer, column C501. An additional thermal coupling of the butanes distributor column through stream REB1 to the bottom of an upstream low pressure deethanizer or propane distributor column reduces the bottoms temperature of the upstream low pressure deethanizer or propane distributor column and consequently reduces the reflux required in the butanes distributor column, column C500. A further thermal coupling is used in this example with the normal butane distributor column, column C502. A vapor sidedraw from stage 19 of column C502 is fed to the bottom stage of column C500 to supply at least a part of the reboiling duty required for the separation in that column.

Column C500 is preferably operated at about 255 psia. The pressure of column C500 is preferably slightly higher than that of columns C501 to facilitate the benefits of thermal coupling by exchange of vapor and liquid streams. Column C500 is partially interreboiled in exchangers E500, E501 and E502 to provide energy for the vapor sidedraw, stream REB1. The reboiler for column C300 has been eliminated. The partial interreboilers, exchangers E500, E501 and E502 are preferably heat integrated with hot streams from elsewhere in the process.

Column C500 is refluxed by recycle liquid in stream 504 from column C501. This thermal coupling through recycle flow raises the overhead vapor stream temperature of column C500 and reduces the reboiler duty of downstream depropanizer column C501. In addition to its primary function of separating propane from gasoline, column C500 also partially separates the butanes into a relatively isobutane rich net overhead vapor stream and a relatively isobutane lean net bottoms liquid product. This enhances the normal butane recovery in the bottom product from column C502 and significantly contributes to the thermal efficiency of the process.

Column C501 is fed by the gasoline-free overhead product from column C500 and separates propane in its overhead product, stream 511, from butanes in its bottoms liquid product. Column C501 preferably operates at about 250 psia so that its overhead propane product can be totally condensed with cooling water, and a vapor overhead product, REB2, may be used to reboil upstream deethanization stages (not shown). The net overhead liquid product, stream 511, of column C501 is typically completely condensed and pumped to battery limits conditions.

The normal butane (n-C4) distributor column, column C502, is fed with stream 501, the bottoms liquid product from column C500. Column C302 separates substantially all the net isobutane in its feed, stream 501, to its overhead liquid product, stream 513. Column C502 further separates substantially all the net gasoline in its feed, stream 501, to the liquid bottoms product, stream 517, while distributing normal butane between the overhead and bottoms products.

Column C502 is partially refluxed using the liquid bottoms product, stream 512, from column C501. A portion of the vapor overhead stream, stream 530, from column C502 is used to reboil column C501. This thermal coupling through recycle flows eliminates the need for a reboilers for columns C501 and C500 and reduces the condenser size for column C502. In indirect heat transfers, a thermal gradient for a process must be matched all along its temperature range with an appropriate minimum temperature approach to the heating or cooling media. An interexchanger that could condense an overhead vapor stream from column C502 against the reboiling duty required for column C501 might be preferable to advantageously reduce utilities, however the requirement of an appropriate approach temperature range between the condensing and reboiling streams means that the columns would have to operate at sufficiently different pressures to generate that approach temperature range. However, with the thermal coupling of columns C501 and C502, column C502 to be operated with a minimum reboiler process-side pressure and temperature of about 266 psia and about 291° F.

A portion of the vapor overhead stream from column C502, containing a butanes mixture with approximately 47% isobutane, is condensed in exchanger E504 by heat integration with cold streams from elsewhere in the process, subcooled in exchangers E506 and E514, and is fed to first and second deisobutanizer columns C503 and C505. The liquid bottoms product, stream 517, from column C502 containing normal butane and gasoline is subcooled by heat integration with cold streams from elsewhere in the process in exchanger E507 and is fed to the debutanizer column C504. About 52% of the normal butane in the net feed to column C502 (44% of the normal butane in the net NGL feed to the process, stream 500) is recovered in the bottoms product, stream 517, and need not be further deisobutanized. The product purity separation of about half of the normal butane from stream 500 in column C502 is an important feature of the present invention of this example and contributes significantly to the thermodynamic efficiency of the process.

The debutanizer, column C504, separates normal butane in its overhead vapor stream, stream 519, from gasoline in its bottoms liquid product, stream 520. The feed to column C504 is a subcooled and deisobutanized bottoms product from upstream normal butane distributor column C502. Column C504 operates at about 150 psia so that its vapor overhead stream, stream 519, may be used to partially reboil the first deisobutanizer, column C503 which in turn provides reflux, as a portion of stream 523, for column C504. This thermal coupling through recycle flows eliminates the need for an interexchanger, as described above for columns C501 and C502. Column C504 is thus operated with a minimum reboiler process pressure and temperature of about 153 psia and about 277° F. An interreboiler, exchanger E509, is preferably heat integrated with hot streams from elsewhere in the process and may be used on column C504 to reduce the hot utility required in the reboiler. The gasoline bottoms liquid product, stream 520, from column C504 is preferably cooled by heat integration with cold streams from elsewhere in the process and is pumped to battery limits conditions.

First deisobutanizer, column C503, is operated at a substantially higher pressure than the second deisobutanizer, column C505, and separates isobutane in its overhead liquid product, stream 525, from normal butane in a portion of its bottoms liquid product, stream 524. Column C503 is fed with stream 515, which comprises about 44% of the condensed mixed butanes overhead liquid product of column C502, stream 515. Column C503 operates at about 145 psia so that its condenser (exchanger E511) temperature is high enough to supply reboil heat to the second deisobutanizer, column C505 in a similar manner to that described for example 4 for the condenser of column 303 and the reboiler of column 305.

The feed rate to column C503 may be manipulated in operation to flexibly adapt to changes in relative iso- and normal butane composition in the feed to the process of the present example. The column C503 condenser duty for exchanger E511 approximately matches the column C505 reboiler duty for exchanger E512. Column C503 is partially reboiled by feeding the overhead vapor stream from column C504 to the bottom stage of column C503. The bottoms liquid product from column C503 comprises product specification normal butane in stream 524. The remainder of the reboiler duty for column C503 is supplied through exchanger E510 by heat integration with hot streams elsewhere in the process.

Column C505 preferably separates product specification isobutane in its overhead liquid product, stream 527, from product specification normal butane in its bottoms liquid product, stream 526. Column C505 is fed with about 56% of the condensed and subcooled mixed butanes in stream 516. Column C505 operates at about 80 psia so that its condenser, exchanger E513, can be cooled with cooling water. The column is reboiled using heat from the condenser of column C503. The reboiling energy supplied to column C504 through exchanger E508 is used three times in series before finally rejecting it to cooling water in the column C505 condenser, exchanger E513. The series usage of the reboiling energy comprises (1) a double effect generated in column C505 linking it with column C503 through an interexchanger and (2) thermally coupling column C503 with column C504. This triple use of energy contributes significantly to the thermal efficiency of the process, as described similarly for the debutanizer reboiler of example 3. The bottoms liquid product, stream 526, from column C505 is combined with the subcooled bottoms liquid product, stream 524, from column C503 as stream 529, is preferably further subcooled, and is pumped to battery limits conditions. The overhead liquid product, stream 527, from column C505 is combined with the subcooled isobutane liquid stream 525 from column C503 and pumped to battery limits conditions.

Figure 5B:
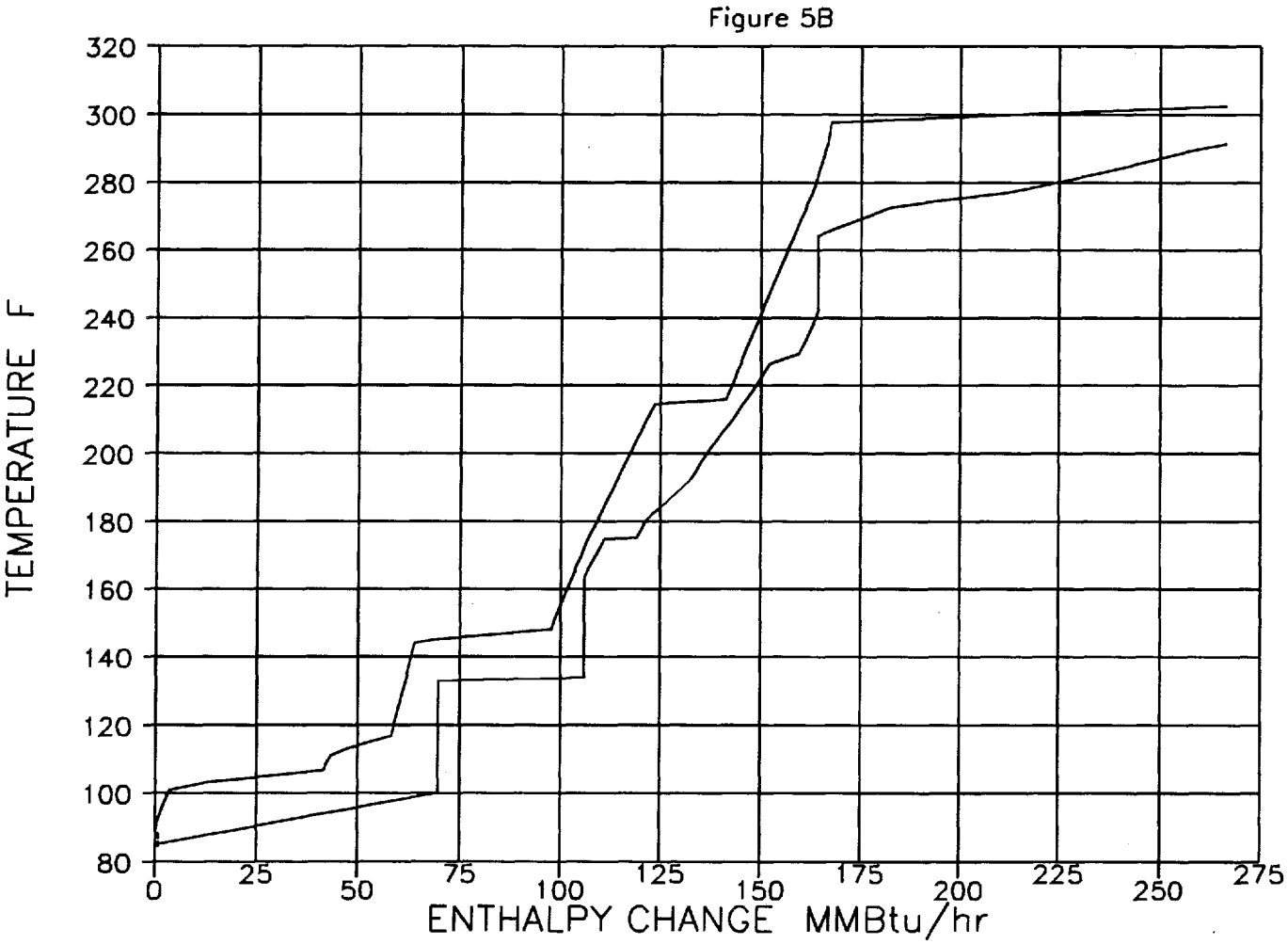

FIG. 5B shows process composite heating and cooling curves for the process in FIG. 5A. About 24 MBtu/bbl of feed of moderately (55 psig) low pressure steam hot utility are required. In comparison with the low pressure normal butane distributor process in example 3, the high pressure normal butane distributor process in the present example uses somewhat less steam, but uses somewhat higher pressure steam. Consequently, the optimum choice of process will depend somewhat on the source and nature of the hot utility used to heat the reboilers. The high pressure normal butane distributor process in FIG. 5A may also be mechanically reconfigured to minimize capital costs in a manner similar to the reconfiguration described above in comparison of examples 3 and 4 for the low pressure normal butane distributor process

EXAMPLE 6

Additional Embodiment of a Intermediate Pressure Normal Butane Distributor Process In this example, an intermediate pressure (about 150 psia) normal butane distributor column is used with an additional novel feature. A rectification section sidedraw of mixed butanes is withdrawn with sufficient stages above the sidedraw to form a relatively high purity isobutane overhead product. In addition, a relatively lower pressure (about 90 psia) debutanizer column further separates the bottoms stream of the normal butanes distributor column. This process of this example uses fewer thermal coupling links between columns, as in the processes described for examples 3, 4 and 5. However, the very low energy consumption of those examples is substantially maintained. Table 6 contains conditions and compositions for the streams shown in FIG. 6A and described as follows:

| Stream No. | Stream Description |
|---|---|
| 600 | deethanized and partially depropanized NGL feed with butanes / gasoline from liquid bottoms stream from a propane distributor column (not shown) |
| 601 | vapor overhead stream from butanes distributor column, column C600 (with about 53 stages) to the depropanizer, column C601 (with about 78 stages), at stage 14. |
| 602 | liquid sidedraw from column C601 / stage 14 to top stage of column C600 |
| 603 | liquid sidedraw for interreboiling from column C600 / stage 14 |
| 604 | partially vaporized liquid sidedraw return to column C600 / stage 21 |
| 605 | liquid sidedraw for interreboiling from column C600 / stage 21 |
| 606 | partially vaporized liquid sidedraw return to column C600 / stage 28 |
| 607 | liquid sidedraw for interreboiling from column C600 / stage 28 |
| 608 | partially vaporized liquid sidedraw return to column C600 / stage 35 |
| 609 | liquid bottoms product from column C600 to first deisobutanizer, column C602 (with about 78 stages), at stage 54 |
| 610 | bottoms liquid product (normal butane) from column C601 |
| 611 | overhead liquid product (propane) from column C601 to propane product stream |
| 612 | vapor sidedraw from column C601 / stage 34 to second deisobutanizer, column C604 (with about 59 stages), at upper feed stage 17 |
| 613 | bottoms liquid product from column C602 to debutanizer, column C603 (with about 23 stages), at stage 14 |
| 614 | overhead liquid product (isobutane) from column C602 |
| 615 | bottoms liquid product (gasoiine) from column C603 |
| 616 | overhead vapor stream from column C603 to bottom stage of column C604 |
| 617 | bottoms liquid product from column C604 to normal butane product stream and to top stage of column C603 |
| 618 | bottoms liquid product (normal butane) from column C604 |
| 619 | overhead liquid product (isobutane) from column C604 |
| 620 | liquid sidedraw from column C602 / stage 39 to column C604 / lower feed stage 35 |
| REB1 | vapor sidedraw from column C600 to bottom stage of propane distribution column (not shown) or low pressure deethanization stages (not shown) |
| REB2 | overhead vapor product from column C601 to bottom stage of low pressure deethanization stages (not shown) |

Figure 6A:
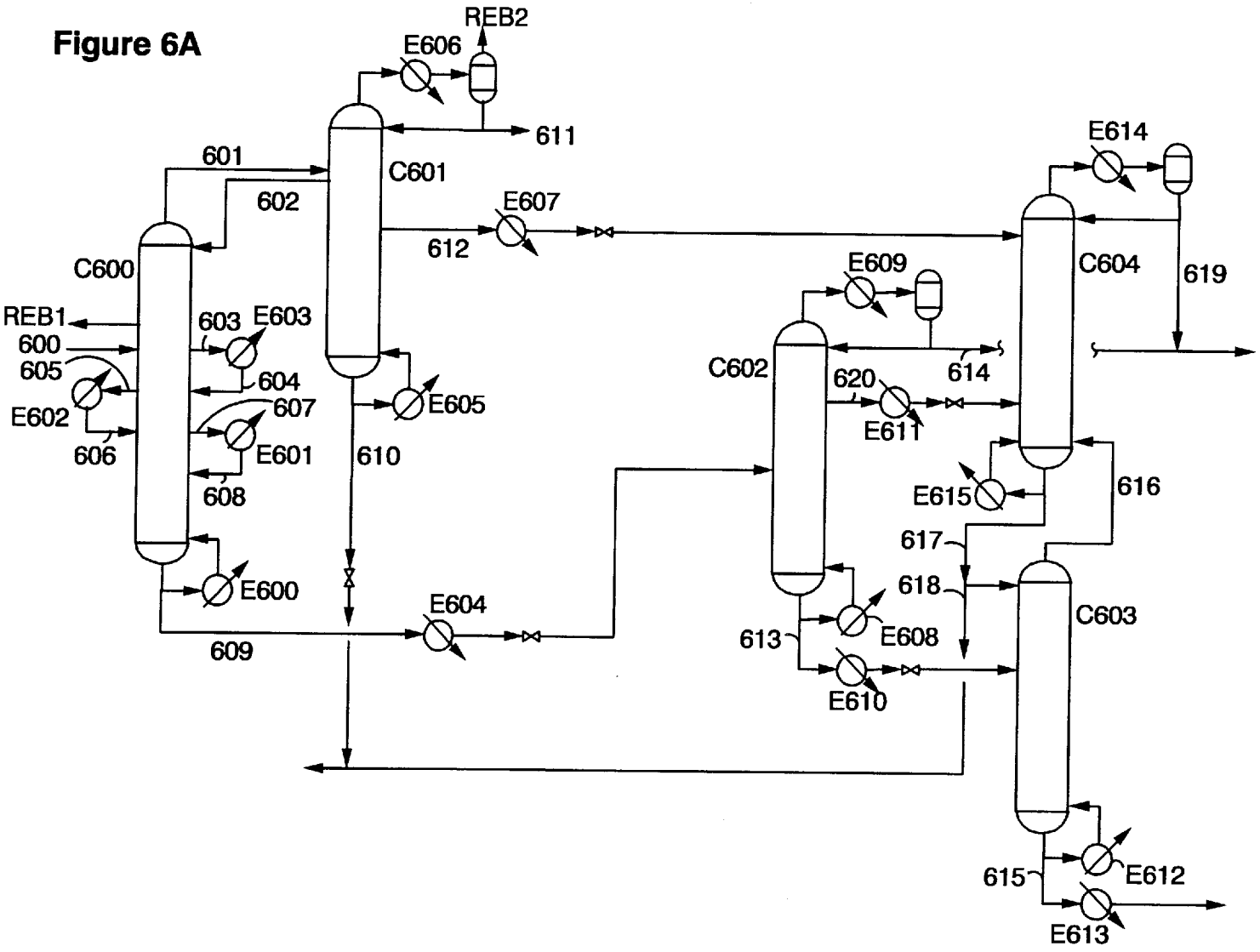
FIG. 6A is a portion of an integrated fractionation sequence for deethanized or partially depropanized NGL. The portion shown is a partial depropanization, deisobutanization and debutanization of thermally coupled streams from an upstream deethanization and partial depropanization. An intermediate pressure normal butane distributor with demixing sidedraw is used.

FIG. 6A also includes exchangers E600 (reboiler for column C600), E601 (bottom interreboiler for column C600), E602 (middle interreboiler for column C600), E603 (top interreboiler for column C600), E604 (subcooler for bottoms liquid product from column C600), E605 (reboiler for column C601), E606 (overhead condenser for column C601), E607 (condenser for vapor sidedraw stream 612), E608 (reboiler for column C602), E609 (overhead condenser for column C602), E610 (subcooler for bottoms liquid product from column C602), E611 (subcooler for liquid sidedraw stream 620 from column C602), E612 (reboiler for column C603), E613 (subcooler for bottoms liquid product from column C603, from which the relatively high temperature heat is integrated into heat recovery to other process heating steps), E614 (overhead condenser for column C604) and E615 (reboiler for column C604).

A deethanized and partially depropanized NGL stream, stream 600, feeds the butanes distributor column, column C600. The vapor sidedraw stream from column C600, stream REB1, is fed to the bottom stage of a low pressure deethanizer or to a propane distributor column, although the withdrawal stage location of the sidedraw is preferably within a few stages of the feed stage for column C600. The feed to column C602, stream 609, has been depropanized in column C600, which separates propane in its overhead product, stream 601, from gasoline in its bottoms product, stream 609, while distributing isobutane and normal butane between those overhead and bottoms products. The operation and thermodynamic efficiencies of column C600 is equivalent to those described for column C300 in example 3 above, especially with respect to the thermal linking streams 601 and 602. The operation and thermodynamic efficiencies of column C601 are substantially the same as those of column C301 in example 3 above.

The bottoms liquid stream of column C602, stream 613, contains the gasoline and a portion of the normal butane in the feed to column C603, stream 609. Column C603 separates the gasoline to a liquid bottoms stream, stream 615, and the normal butane to an overhead vapor stream, stream 616. Stream 616 is fed to the bottom stage of column C604 to supply at least a portion of the reboiling duty for that column. The columns C603 and C604 thus obtain the above described benefits from thermal coupling, although reboiling is optionally supplemented to column C604, as with exchanger E615. The overhead liquid product of column C602 is product specification isobutane and becomes part of the isobutane product stream. The overhead liquid product of columns C604 (stream 619) also comprises product specification isobutane and also becomes part of the isobutane product stream.

A liquid sidedraw, stream 620, from column C602 provides a lower feed to column C604. Withdrawing this liquid sidedraw results in an unexpected efficiency—adding stages above the point at which stream 620 is withdrawn does not change the condensing duty of the overhead condenser, exchanger E609, or reboiling duty of the reboiler, exchanger E608, although (1) the degree of separation between the sidedraw stream 620 and the bottoms stream 613 remains the same and (2) an overhead liquid product stream 614 may be obtained with variable purity of isobutane. By comparison with this example, the overhead liquid product stream 614 comprises product specification isobutane at the substantially the same condensing duty in exchanger E609 as that of a column with fewer stages than column C602 in which the overhead liquid product comprises streams 614 and 620.

Column C602 thus separates isobutane in its sidedraw stream 620 from gasoline in its bottoms liquid product, stream 613, while distributing normal butane between those streams. The feed to column C602, stream 609, is cooled to approximately its bubble point temperature. Column C602 operates at about 145–150 psia. The reboiler, exchanger E608 is preferably reboiled by heat transfer from a hot utility. The overhead condenser, E609, is preferably cooled at least in part by heat transfer from the condensing vapor to the reboiling process stream of the deisobutanizer, column C604, in exchanger E615. This heat integration or cross-exchanging of heat reduces the number of heat exchangers and the overall utilities consumption of the process.

About 37% of the normal butane in the feed to column C602 is recovered in the bottoms liquid product, stream 613. About 40% of the isobutane in the feed to column C602 is recovered in the overhead liquid product, stream 614. The butanes in these bottom and overhead streams are not processed in the downstream deisobutanizer column, column C604, and this contributes significantly to the energy efficiency of the process.

The normal butane product stream consists of the bottoms liquid product streams of columns C601 and C604. The benefits of butanes distribution are obtained in the present example, in a manner similar to that described in the above examples. The debutanizer, column C603, 85–90 psia to minimize the temperatures in the reboiler, exchanger E612, thereby reducing the temperature of the reboiling utility. In addition, the relatively low pressure of column C603 matches that of column C604, the deisobutanizer, so that stream 616 may be used to partially reboil column C604. Column C603 is refluxed by recycle liquid normal butane in stream 617 from column C604. This refluxing by recycle flow eliminates the need for a condenser for column C603 and thermally couples columns C603 and C604. The thermal driving force necessary to operate a reboiler / condenser which cross-exchanges the heat between the condenser of the debutanizer and the reboiler of the deisobutanizer is thus not a process limitation when such thermal coupling is used. The liquid gasoline bottoms product, stream 615, from column C603, is cooled by heat integration with cold streams from elsewhere in the process and is pumped to battery limits conditions.

Deisobutanizer, column C604, separates isobutane in its overhead product from normal butane in its bottoms product and operates at about 80 psia so that cooling water may be used as a heat sink in its condenser, exchanger E614. Column C604 feed comprises approximately 27% isobutane and 73% normal butane in stream 620 and, in stream 612, about 59% isobutane which has been subcooled in exchanger E607 before flashing to column pressure.

Figure 6B:
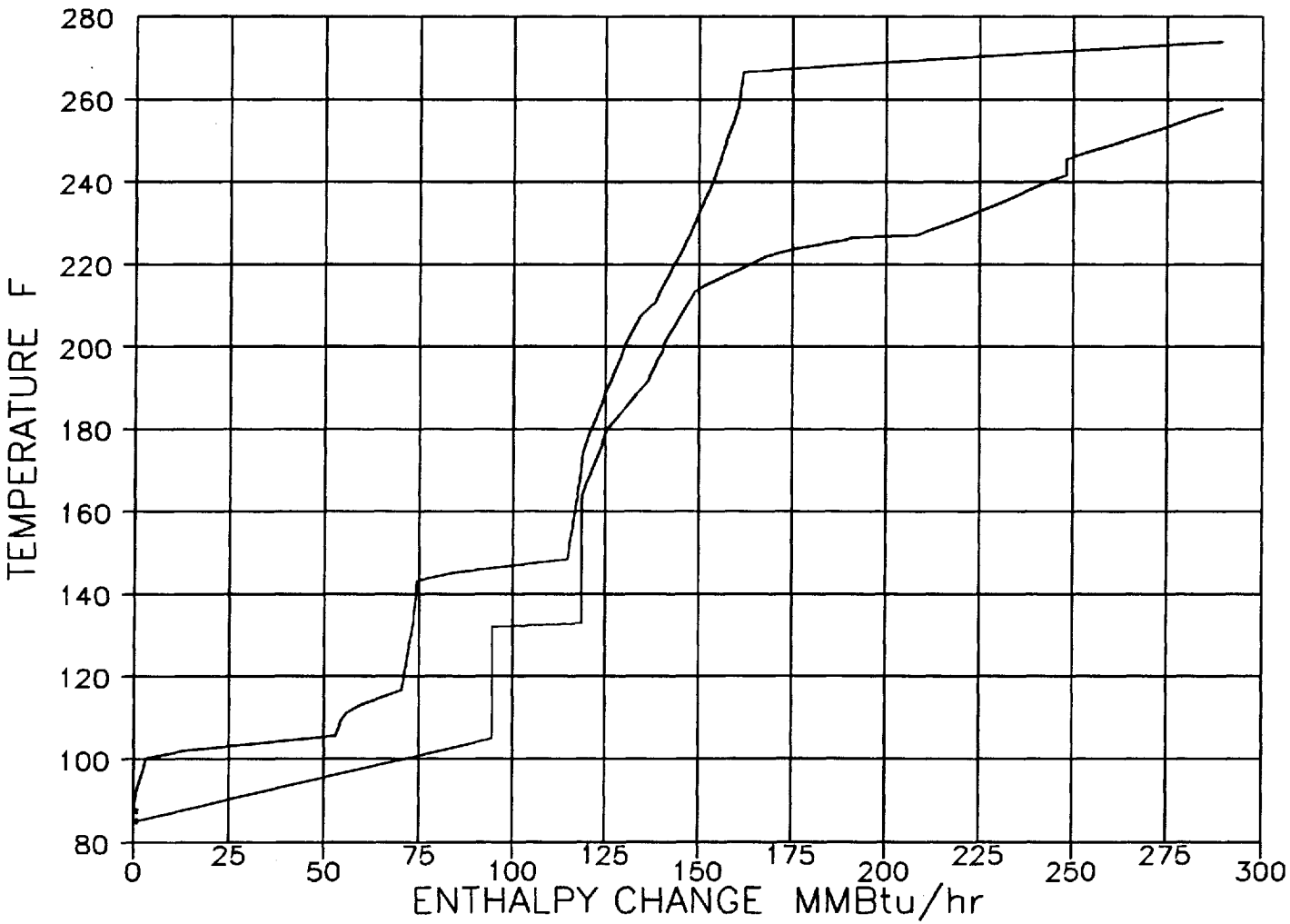
FIG. 6B shows process composite heating and cooling curves for the process in this example and shown in FIG. 6A.

FIG. 6B shows process composite heating and cooling curves for the process in this example and shown in FIG. 6A. About 31 MBtu/bbl of feed very low pressure steam (30 psig) hot utility are required. This is slightly more than for the thermally coupled low pressure normal butane distributor process described for examples 3 and 4.

The above descriptions of generation of partial effects and thermal coupling means in relation to NGL separation of propane, butanes and gasoline are not specific limitations to the concept of the present invention. The mechanical reconfiguration of the present invention from example 3 to example 4 displays the flexibility of movement of rectification and stripping sections to achieve lower capital costs. Although the number and location of interreboilers has been optimized for the above examples, such choices, with the above disclosure, will be within the ability of the skilled person to change that number and/or location and still achieve the objects of the present invention. More importantly, the use of thermal coupling, where not necessary to achieve the objects of the present invention, may replaced with conventional systems of reboilers and/or condensers. Other specific teachings concerning numbers of separation stages in the several columns and withdrawal and feed stages are optimized for those examples and teach the skilled person that other choices may be made concerning those and other design choices while still obtaining the objects of the present invention.

As indicated above, the specific examples herein are optimized for obtaining a currently desirable purity in propane, iso- and normal butanes, and gasoline. An increase or decrease in product purity or thermodynamic efficiency are within the objects of the present invention while still using the concepts of the present invention, such as (1) a butanes distribution column followed in sequence by a normal butane distributor column, (2) thermally coupling a normal butane distributor column to a debutanizer and a partial effect deisobutanizer, (3) interexchanging the condensing duty of a partial effect deisobutanizer of item (2) with the reboiling duty of a lower pressure deisobutanizer, or (4) balancing or controlling relative amounts and total flow of iso- and normal butane in the feed to partial effect deisobutanizer. Optimizing choices the many design options will occur to the skilled person upon disclosure of the above examples. Such design options include, but are not limited to, location of feed and sidedraw stages, the number and pressure levels of the columns, temperature levels and duties of the heat exchangers, the number of stages in a column or supplementation of thermal coupling refluxing or reboiling with additional condensers/intercondensers or reboilers/interreboilers. Those design options will sometimes present the designer with considerable and wide ranges from which to choose appropriate process modifications for the above examples. However, the objects of the present invention will still be obtained by the skilled person applying such design options in an appropriate manner.

TABLE 1

| Stream | 100 | 101 | 102 |
|---|---|---|---|
| Vap. Frac. | 0.0000 | 0.0000 | 0.0000 |
| Deg. F. | 144.0 | 100.4 | 134.1 |
| psia | 150.0 | 75.0 | 86.2 |
| lbmole/hr | 3,056 | 880 | 2,176 |
| Mlb/hr | 177.44 | 50.80 | 126.63 |
| barrel/day | 21,086 | 6,199 | 14,887 |
| Comp: barrel/day | | | |
| Propane | 138 | 138 | 0 |
| i-Butane | 6,620 | 5,951 | 669 |
| n-Butane | 14,252 | 110 | 14,142 |
| i-Pentane | 73 | 0 | 73 |
| n-Pentane | 2 | 0 | 2 |

TABLE 2

| Stream | 200 | 201 | 202 | 203 | 204 |
|---|---|---|---|---|---|
| Vap. Frac. | 0.0000 | 0.0000 | 0.0000 | 0.0000 | 0.0000 |
| Deg. F. | 144.0 | 142.6 | 161.8 | 100.4 | 133.8 |
| psia | 150.0 | 115.0 | 124.2 | 75.0 | 86.2 |
| lbmole/hr | 3,056 | 1,785 | 1,271 | 880 | 905 |
| Mlb/hr | 177.44 | 103.43 | 74.01 | 50.80 | 52.63 |
| barrel/day | 21,086 | 12,389 | 8,696 | 6,199 | 6,190 |
| Comp: barrel/day | | | | | |
| Propane | 138 | 138 | 0 | 138 | 0 |
| i-Butane | 6,620 | 6,260 | 360 | 5,951 | 309 |
| n-Butane | 14,252 | 5,991 | 8,262 | 110 | 5,881 |
| i-Pentane | 73 | 0 | 73 | 0 | 0 |
| n-Pentane | 2 | 0 | 2 | 0 | 0 |

TABLE 3

| Stream | 300 | 301 | 302 | 303 | 304 | 305 | 306 | 307 | 308 | 309 | 310 |
|---|---|---|---|---|---|---|---|---|---|---|---|
| Vap. Frac | 0.0000 | 1.0000 | 0.0000 | 0.0000 | 0.7031 | 0.0000 | 0.5386 | 0.0000 | 0.9896 | 0.0000 | 0.0000 |
| Deg. F | 159.1 | 150.4 | 149.5 | 163.7 | 191.8 | 180.0 | 199.0 | 200.0 | 240.1 | 257.8 | 173.7 |
| psia | 257.1 | 255.8 | 255.7 | 257.2 | 257.9 | 260.6 | 258.6 | 261.3 | 259.3 | 261.6 | 150.0 |
| lbmole/hr | 13,661 | 6,704 | 2,626 | 2,278 | 2,278 | 2,823 | 2,823 | 2,890 | 2,890 | 4,321 | 4,321 |
| Mlb/hr | 722.02 | 314.07 | 129.39 | 120.77 | 120.77 | 156.04 | 156.04 | 167.76 | 167.76 | 287.01 | 287.01 |
| barrel/day | 90,019 | 41,467 | 16,625 | 15,000 | 15,000 | 19,000 | 19,000 | 20,000 | 20,000 | 32,377 | 32,377 |
| Comp: barrel/day | | | | | | | | | | | |
| Methane | 0 | 0 | 0 | 0 | 0 | 0 | 0 | 0 | 0 | 0 | 0 |
| Ethane | 2,765 | 1,620 | 198 | 197 | 197 | 24 | 24 | 3 | 3 | 0 | 0 |
| Propane | 41,523 | 28,804 | 9,470 | 7,129 | 7,129 | 7,061 | 7,061 | 4,486 | 4,486 | 108 | 108 |
| i-Butane | 10,181 | 5,030 | 3,149 | 1,780 | 1,780 | 3,009 | 3,009 | 4,141 | 4,141 | 5,192 | 5,192 |
| n-Butane | 19,587 | 5,982 | 3,789 | 3,370 | 3,370 | 5,279 | 5,279 | 7,012 | 7,012 | 12,591 | 12,591 |
| i-Pentane | 5,763 | 29 | 16 | 954 | 954 | 1,390 | 1,390 | 1,699 | 1,699 | 4,987 | 4,987 |
| n-Pentane | 3,935 | 2 | 1 | 636 | 636 | 921 | 921 | 1,116 | 1,116 | 3,499 | 3,499 |
| n-Hexane | 4,213 | 0 | 0 | 634 | 634 | 898 | 898 | 1,057 | 1,057 | 4,000 | 4,000 |
| n-Heptan | 2,051 | 0 | 0 | 299 | 299 | 419 | 419 | 486 | 486 | 2,000 | 2,000 |

| Stream | 311 | 312 | 313 | 314 | 315 | 316 | 317 | 318 | 319 | 320 | 322 |
|---|---|---|---|---|---|---|---|---|---|---|---|
| Vap. Frac | 1.0000 | 0.0000 | 0.0000 | 1.0000 | 0.0000 | 1.0000 | 0.0000 | 0.0000 | 1.0000 | 1.0000 | 0.0000 |
| Deg. F | 119.4 | 227.0 | 173.3 | 211.0 | 100.1 | 154.1 | 153.8 | 187.3 | 186.0 | 161.6 | 260.0 |
| psia | 249.4 | 262.6 | 150.0 | 257.7 | 140.0 | 120.9 | 120.8 | 125.4 | 125.3 | 123.9 | 128.2 |
| lbmole/hr | 3,560 | 189 | 189 | 329 | 329 | 4,740 | 2,854 | 7,138 | 4,703 | 2,303 | 1,783 |
| Mlb/hr | 154.61 | 11.01 | 11.01 | 19.06 | 19.06 | 275.51 | 166.01 | 464.40 | 286.89 | 133.97 | 139.65 |
| barrel/day | 21,258 | 1,294 | 1,294 | 2,290 | 2,290 | 32,720 | 19,675 | 52,498 | 33,166 | 15,755 | 14,876 |
| Comp: barrel/day | | | | | | | | | | | |
| Methane | 0 | 0 | 0 | 0 | 0 | 0 | 0 | 0 | 0 | 0 | 0 |
| Ethane | 1,422 | 0 | 0 | 0 | 0 | 0 | 0 | 0 | 0 | 0 | 0 |
| Propane | 19,305 | 0 | 0 | 28 | 28 | 136 | 28 | 0 | 0 | 0 | 0 |
| i-Butane | 482 | 58 | 58 | 1,341 | 1,341 | 10,102 | 5,178 | 1,414 | 1,148 | 835 | 1 |
| n-Butane | 50 | 1,224 | 1,224 | 919 | 919 | 22,303 | 14,357 | 29,830 | 25,184 | 14,856 | 446 |
| i-Pentane | 0 | 11 | 11 | 2 | 2 | 170 | 107 | 8,893 | 3,968 | 61 | 4,933 |
| n-Pentane | 0 | 1 | 1 | 0 | 0 | 9 | 5 | 5,484 | 1,988 | 3 | 3,496 |
| n-Hexane | 0 | 0 | 0 | 0 | 0 | 0 | 0 | 4,725 | 725 | 0 | 4,000 |
| n-Heptan | 0 | 0 | 0 | 0 | 0 | 0 | 0 | 2,153 | 153 | 0 | 2,000 |

| Stream | 323 | 324 | 325 | 326 | 327 | 328 | 329 | 330 | REB1 | REB2 |
|---|---|---|---|---|---|---|---|---|---|---|
| Vap. Frac | 0.0000 | 0.6507 | 0.0000 | 0.0000 | 0.0000 | 0.0000 | 0.0000 | 0.0000 | 1.0000 | 1.0000 |
| Deg. F | 186.0 | 200.9 | 143.2 | 161.4 | 161.6 | 100.4 | 90.6 | 90.6 | 163.7 | 119.4 |
| psia | 125.3 | 126.3 | 115.0 | 123.8 | 123.9 | 75.0 | 81.2 | 81.2 | 257.2 | 249.4 |
| lbmole/hr | 2,731 | 2,731 | 1,468 | 2,910 | 1,259 | 874 | 923 | 2,182 | 5,261 | 1,002 |
| Mlb/hr | 176.57 | 176.57 | 85.07 | 169.41 | 73.31 | 50.48 | 53.65 | 126.95 | 250.33 | 43.49 |
| barrel/day | 20,000 | 20,000 | 10,180 | 19,914 | 8,615 | 6,160 | 6,309 | 14,925 | 32,800 | 5,980 |
| Comp: barrel/day | | | | | | | | | | |
| Methane | 0 | 0 | 0 | 0 | 0 | 0 | 0 | 0 | 0 | 0 |
| Ethane | 0 | 0 | 0 | 0 | 0 | 0 | 0 | 0 | 1,343 | 400 |
| Propane | 0 | 0 | 108 | 0 | 0 | 136 | 0 | 0 | 22,082 | 5,430 |
| i-Butane | 430 | 430 | 4,886 | 933 | 363 | 5,914 | 314 | 677 | 3,109 | 135 |
| n-Butane | 11,754 | 11,754 | 5,185 | 18,839 | 8,183 | 111 | 5,994 | 14,177 | 4,804 | 14 |
| i-Pentane | 3,458 | 3,458 | 0 | 135 | 65 | 0 | 2 | 67 | 764 | 0 |
| n-Pentane | 2,047 | 2,047 | 0 | 7 | 4 | 0 | 0 | 4 | 435 | 0 |
| n-Hexane | 1,606 | 1,606 | 0 | 0 | 0 | 0 | 0 | 0 | 213 | 0 |
| n-Heptan | 705 | 705 | 0 | 0 | 0 | 0 | 0 | 0 | 51 | 0 |

Exchangers

| No. | E300 | E301 | E302 | E303 | E304 | E305 | E306 | E307 | E308 | E309 |
|---|---|---|---|---|---|---|---|---|---|---|
| MMBtu/hr | 41.23 | 21.35 | 10.57 | 11.19 | 17.13 | 15.75 | 33.19 | 3.36 | 0.45 | 44.29 |

| No. | E310 | E311 | E312 | E313 | E314 | E315 | E316 |
|---|---|---|---|---|---|---|---|
| MMBtu/hr | 15.56 | 0.64 | 54.85 | 52.71 | 53.90 | 3.30 | 1.43 |

TABLE 5

| Stream | 500 | 501 | 502 | 503 | 504 | 505 | 506 | 507 | 508 | 509 |
|---|---|---|---|---|---|---|---|---|---|---|
| Vap. Frac. | 0.0000 | 0.0000 | 1.0000 | 1.0000 | 0.0000 | 0.0000 | 0.7122 | 0.0000 | 0.5626 | 0.0000 |
| Deg. F | 159.1 | 238.2 | 237.2 | 150.5 | 149.7 | 163.7 | 192.3 | 180.0 | 200.0 | 200.0 |

TABLE 5-continued

| | | | | | | | | | | |
|---|---|---|---|---|---|---|---|---|---|---|
| psia | 257.1 | 261.2 | 261.3 | 255.8 | 255.7 | 257.2 | 257.9 | 257.9 | 258.6 | 258.6 |
| lbmole/hr | 13,661 | 10,506 | 6,179 | 6,697 | 2,624 | 2,278 | 2,278 | 2,823 | 2,823 | 2,889 |
| Mlb/hr | 722.03 | 658.46 | 371.17 | 313.85 | 129.44 | 120.77 | 120.77 | 156.05 | 156.05 | 167.78 |
| barrel/day | 90,019 | 76,013 | 43,600 | 41,431 | 16,625 | 15,000 | 15,000 | 19,000 | 19,000 | 20,000 |
| Comp: barrel/day | | | | | | | | | | |
| Methane | 0 | 0 | 0 | 0 | 0 | 0 | 0 | 0 | 0 | 0 |
| Ethane | 2,765 | 0 | 0 | 1,617 | 196 | 198 | 198 | 25 | 25 | 3 |
| Propane | 41,523 | 401 | 264 | 28,723 | 9,420 | 7,129 | 7,129 | 7,064 | 7,064 | 4,502 |
| i-Butane | 10,181 | 19,273 | 14,077 | 5,084 | 3,207 | 1,779 | 1,779 | 3,001 | 3,001 | 4,105 |
| n-Butane | 19,587 | 35,697 | 23,102 | 5,975 | 3,783 | 3,370 | 3,370 | 5,278 | 5,278 | 7,006 |
| i-Pentane | 5,763 | 8,250 | 3,263 | 29 | 16 | 954 | 954 | 1,391 | 1,391 | 1,708 |
| n-Pentane | 3,935 | 5,322 | 1,823 | 2 | 1 | 636 | 636 | 922 | 922 | 1,122 |
| n-Hexane | 4,213 | 4,854 | 854 | 0 | 0 | 634 | 634 | 899 | 899 | 1,065 |
| n-Heptane | 2,051 | 2,216 | 216 | 0 | 0 | 299 | 299 | 419 | 419 | 490 |

| Stream | 510 | 511 | 512 | 513 | 514 | 515 | 516 | 517 | 518 | 519 |
|---|---|---|---|---|---|---|---|---|---|---|
| Vap. Frac. | 1.0000 | 1.0000 | 0.0000 | 0.0000 | 0.0000 | 0.0000 | 0.0273 | 0.0000 | 0.0000 | 1.0000 |
| Deg. F | 242.4 | 119.4 | 213.0 | 214.0 | 145.0 | 144.8 | 113.9 | 291.4 | 173.8 | 175.5 |
| psia | 259.3 | 249.4 | 257.7 | 257.8 | 252.8 | 150.0 | 75.0 | 265.7 | 150.0 | 147.3 |
| lbmole/hr | 2,889 | 3,565 | 2,903 | 2,115 | 2,115 | 938 | 1,177 | 2,719 | 2,719 | 3,399 |
| Mlb/hr | 167.78 | 154.80 | 168.38 | 122.77 | 122.77 | 54.46 | 68.31 | 194.12 | 194.12 | 197.65 |
| barrel/day | 20,000 | 21,283 | 20,123 | 14,654 | 14,654 | 6,500 | 8,154 | 21,281 | 21,281 | 23,242 |
| Comp: barrel/day | | | | | | | | | | |
| Methane | 0 | 0 | 0 | 0 | 0 | 0 | 0 | 0 | 0 | 0 |
| Ethane | 3 | 1,421 | 0 | 0 | 0 | 0 | 0 | 0 | 0 | 0 |
| Propane | 4,502 | 19,330 | 190 | 110 | 110 | 49 | 61 | 0 | 0 | 0 |
| i-Butane | 4,105 | 483 | 9,130 | 6,280 | 6,280 | 2,785 | 3,494 | 309 | 309 | 1,127 |
| n-Butane | 7,006 | 49 | 10,761 | 8,221 | 8,221 | 3,647 | 4,574 | 6,516 | 6,516 | 22,052 |
| i-Pentane | 1,708 | 0 | 39 | 40 | 40 | 18 | 22 | 4,960 | 4,960 | 60 |
| n-Pentane | 1,122 | 0 | 3 | 4 | 4 | 2 | 2 | 3,496 | 3,496 | 2 |
| n-Hexane | 1,065 | 0 | 0 | 0 | 0 | 0 | 0 | 4,000 | 4,000 | 0 |
| n-Heptane | 490 | 0 | 0 | 0 | 0 | 0 | 0 | 2,000 | 2,000 | 0 |

| Stream | 520 | 521 | 521 | 522 | 523 | 524 | 525 | 526 | 527 | 528 |
|---|---|---|---|---|---|---|---|---|---|---|
| Vap. Frac. | 0.0000 | 1.0000 | 0.0000 | 0.1197 | 0.0000 | 0.0000 | 0.0000 | 0.0000 | 0.0000 | 0.0000 |
| Deg. F | 276.8 | 214.0 | 226.4 | 229.4 | 175.2 | 175.5 | 144.1 | 133.7 | 100.9 | 100.5 |
| psia | 152.5 | 257.8 | 150.3 | 150.8 | 147.2 | 147.3 | 135.0 | 85.7 | 75.0 | 75.0 |
| lbmole/hr | 1,782 | 2,395 | 5,635 | 5,635 | 3,939 | 1,478 | 397 | 694 | 483 | 881 |
| Mlb/hr | 139.60 | 138.77 | 392.44 | 392.44 | 229.10 | 85.97 | 22.99 | 40.35 | 27.96 | 50.94 |
| barrel/day | 14,871 | 16,600 | 43,365 | 43,365 | 29,936 | 10,104 | 2,804 | 4,744 | 3,410 | 6,213 |
| Comp: barrel/day | | | | | | | | | | |
| Methane | 0 | 0 | 0 | 0 | 0 | 0 | 0 | 0 | 0 | 0 |
| Ethane | 0 | 0 | 0 | 0 | 0 | 0 | 0 | 0 | 0 | 0 |
| Propane | 0 | 217 | 0 | 0 | 0 | 0 | 49 | 0 | 61 | 110 |
| i-Butane | 1 | 7,736 | 157 | 157 | 1,215 | 396 | 2,699 | 214 | 3,281 | 5,979 |
| n-Butane | 445 | 8,618 | 14,329 | 14,329 | 25,640 | 9,658 | 56 | 4,506 | 68 | 124 |
| i-Pentane | 4,929 | 26 | 13,085 | 13,085 | 78 | 49 | 0 | 22 | 0 | 0 |
| n-Pentane | 3,496 | 2 | 7,747 | 7,747 | 4 | 2 | 0 | 2 | 0 | 0 |
| n-Hexane | 4,000 | 0 | 5,668 | 5,668 | 0 | 0 | 0 | 0 | 0 | 0 |
| n-Heptane | 2,000 | 0 | 2,379 | 2,379 | 0 | 0 | 0 | 0 | 0 | 0 |

| Stream | 529 | 530 | REB1 | REB2 |
|---|---|---|---|---|
| Vap. Frac. | 0.0000 | 1.0000 | 1.0000 | 1.0000 |
| Deg. F | 133.7 | 214.0 | 163.7 | 119.4 |
| psia | 85.7 | 257.8 | 257.2 | 249.4 |
| lbmole/hr | 2,171 | 2,395 | 5,261 | 1,002 |
| Mlb/hr | 126.32 | 138.77 | 250.33 | 43.49 |
| barrel/day | 14,848 | 16,600 | 32,800 | 5,980 |
| Comp: barrel/day | | | | |
| Methane | 0 | 0 | 0 | 0 |
| Ethane | 0 | 0 | 1,345 | 399 |
| Propane | 0 | 217 | 22,082 | 5,431 |
| i-Butane | 610 | 7,736 | 3,108 | 136 |
| n-Butane | 14,164 | 8,618 | 4,803 | 14 |
| i-Pentane | 71 | 26 | 764 | 0 |
| n-Pentane | 4 | 2 | 435 | 0 |
| n-Hexane | 0 | 0 | 213 | 0 |
| n-Heptane | 0 | 0 | 51 | 0 |

TABLE 5-continued

| Exchangers | | | | | | | | | | |
|---|---|---|---|---|---|---|---|---|---|---|
| Exch. No. | E500 | E501 | E502 | E503 | E504 | E505 | E506 | E507 | E508 | E509 |
| MMBtu/hr | 21.77 | 11.07 | 11.35 | 33.56 | 73.60 | 6.17 | 16.05 | 28.79 | 5.93 | 8.23 |
| Exch. No. | E510 | E511 | E512 | E513 | E514 | E515 | E516 | | | |
| MMBtu/hr | 32.67 | 36.24 | 36.22 | 1.09 | 2.42 | 17.47 | 0.65 | | | |

TABLE 6

| Stream | 600 | 601 | 602 | 603 | 604 | 605 | 606 | 607 | 608 | 609 |
|---|---|---|---|---|---|---|---|---|---|---|
| Vap. Frac. | 0.0000 | 1.0000 | 0.0000 | 0.0000 | 0.7031 | 0.0000 | 0.5386 | 0.0000 | 0.9896 | 0.0000 |
| Deg. F. | 159.1 | 150.4 | 149.5 | 163.7 | 191.8 | 180.0 | 199.0 | 200.0 | 240.1 | 257.8 |
| psia | 257.1 | 255.8 | 255.7 | 257.2 | 257.9 | 260.6 | 258.6 | 261.3 | 259.3 | 261.6 |
| lbmole/hr | 13,661 | 6,704 | 2,626 | 2,278 | 2,278 | 2,823 | 2,823 | 2,890 | 2,890 | 4,321 |
| Mlb/hr | 722.02 | 314.07 | 129.39 | 120.77 | 120.77 | 156.04 | 156.04 | 167.76 | 167.76 | 287.01 |
| barrel/day | 90,019 | 41,467 | 16.625 | 15,000 | 15,000 | 19,000 | 19,000 | 20,000 | 20,000 | 32,377 |
| Comp: barrel/day | | | | | | | | | | |
| Ethane | 2,765 | 1,620 | 198 | 197 | 197 | 24 | 24 | 3 | 3 | 0 |
| Propane | 41,523 | 28,804 | 9,470 | 7,129 | 7,129 | 7,061 | 7,061 | 4,486 | 4,486 | 108 |
| i-Butane | 10,181 | 5,030 | 3,149 | 1,780 | 1,780 | 3,009 | 3,009 | 4,141 | 4,141 | 5,192 |
| n-Butane | 19,587 | 5,982 | 3,789 | 3,370 | 3,370 | 5,279 | 5,279 | 7,012 | 7,012 | 12,591 |
| i-Pentane | 5,763 | 29 | 16 | 954 | 954 | 1,390 | 1,390 | 1,699 | 1,699 | 4,987 |
| n-Pentane | 3,935 | 2 | 1 | 636 | 636 | 921 | 921 | 1,116 | 1,116 | 3,499 |
| n-Hexane | 4.213 | 0 | 0 | 634 | 634 | 898 | 898 | 1,057 | 1,057 | 4,000 |
| n-Heptane | 2,051 | 0 | 0 | 299 | 299 | 419 | 419 | 486 | 486 | 2,000 |

| Stream | 610 | 611 | 612 | 613 | 614 | 615 | 616 | 617 | 618 | 619 |
|---|---|---|---|---|---|---|---|---|---|---|
| Vap. Frac. | 0.0000 | 1.0000 | 1.0000 | 0.0000 | 0.0000 | 0.0000 | 1.0000 | 0.0000 | 0.0000 | 0.0000 |
| Deg. F. | 227.0 | 119.4 | 211.0 | 241.5 | 143.3 | 226.8 | 133.4 | 132.8 | 132.8 | 100.2 |
| psia | 262.6 | 249.4 | 257.7 | 151.2 | 138.0 | 88.6 | 84.8 | 84.7 | 84.7 | 73.5 |
| lbmole/hr | 189 | 3,560 | 329 | 2,427 | 316 | 1,782 | 2,796 | 4,143 | 1,992 | 560 |
| Mlb/hr | 11.01 | 154.61 | 19.06 | 177.09 | 18.17 | 139.55 | 162.70 | 241.06 | 115.90 | 32.44 |
| barrel/day | 1,294 | 21,258 | 2,290 | 19,280 | 2,221 | 14,866 | 19,127 | 28,338 | 13,625 | 3,955 |
| Comp: barrel/day | | | | | | | | | | |
| Ethane | | 1,422 | | | | | | | | |
| Propane | 0 | 19,305 | 28 | 0 | 88 | 0 | 0 | 0 | 0 | 48 |
| i-Butane | 58 | 482 | 1,341 | 220 | 2,090 | 3 | 878 | 1,275 | 613 | 3,827 |
| n-Butane | 1,224 | 50 | 919 | 4,617 | 44 | 443 | 18,151 | 26,921 | 12,944 | 79 |
| i-Pentane | 11 | 0 | 2 | 4,947 | 0 | 4,925 | 92 | 133 | 64 | 0 |
| n-Pentane | 1 | 0 | 0 | 3,495 | 0 | 3,495 | 4 | 6 | 3 | 0 |
| n-Hexane | 0 | 0 | 0 | 4,001 | 0 | 4,000 | 0 | 0 | 0 | 0 |
| n-Heptane | 0 | 0 | 0 | 1,999 | 0 | 1,999 | 0 | 0 | 0 | 0 |

| Stream | 620 | REB1 | REB2 |
|---|---|---|---|
| Vap. Frac. | 0.0000 | 1.0000 | 1.0000 |
| Deg. F. | 169.2 | 163.7 | 119.4 |
| psia | 146.8 | 257.2 | 249.4 |
| lbmole/hr | 1,578 | 5,261 | 1,002 |
| Mlb/hr | 91.75 | 250.33 | 43.49 |
| barrel/day | 10,876 | 32,800 | 5,980 |
| uz,1/9 Comp: barrel/day | | | |
| Ethane | | 1,343 | 400 |
| Propane | 21 | 22,082 | 5,430 |
| i-Butane | 2,883 | 3,109 | 135 |
| n-Butane | 7,931 | 4,804 | 14 |
| i-Pentane | 39 | 764 | 0 |
| n-Pentane | 3 | 435 | 0 |
| n-Hexane | 0 | 213 | 0 |
| n-Heptane | 0 | 51 | 0 |

| Exch. No. | E600 | E601 | E602 | E603 | E604 | E605 | E606 | E607 | E608 | E609 |
|---|---|---|---|---|---|---|---|---|---|---|
| Enthalpy MMBtu/hr | 41.23 | 21.35 | 10.57 | 11.19 | 17.13 | 15.75 | 33.19 | 3.36 | 46.96 | 39.57 |

TABLE 6-continued

| Exch. No. | E610 | E611 | E612 | E613 | E614 | E615 |
|---|---|---|---|---|---|---|
| Ethalpy MMBtu/hr | 4.98 | 1.6318 | 23.77 | 11.08 | 48.11 | 24.20 |

I claim:

1. A process for NGL fractionation comprising:

(a) a deethanized NGL stream comprising primarily propane, isobutane, normal butane and gasoline range components;

(b) separating the NGL stream in a butanes distributor column to overhead and bottoms streams so that:

(i) substantially all the propane and gasoline components of the NGL stream are separated to the overhead and bottoms streams, respectively; and (ii) substantial amounts of both isobutane and normal butane are separated to the overhead and bottoms streams;

(c) further separating the bottoms stream of the butanes distributor column in a normal butane distributor column to overhead and bottoms streams so that:

(i) substantially all the isobutane and gasoline components of the bottoms stream of the butanes distributor column are separated to the overhead and bottoms streams, respectively; and (ii) substantial amounts of normal butane are separated to the overhead and bottoms streams of the normal butane distributor column.

2. The process of claim 1 wherein the overhead stream of the butanes distributor column is fed to a depropanizer with a stripping section, a sidedraw is withdrawn from the depropanizer stripping section, the sidedraw is further separated in a first deisobutanizer to form an overhead stream of product specification isobutane, and both the first deisobutanizer and the depropanizer produce bottoms streams of product specification normal butane.

3. The process of claim 2 wherein the normal butane distributor column further comprises a rectification section, a sidedraw is withdrawn from the rectification section of the normal butane distributor column, and the sidedraw is fed to a stage of the first deisobutanizer below the stage at which the sidedraw from the depropanizer is fed to the first deisobutanizer.

4. The process of claim 3 wherein the overhead stream from the butanes distributor column is a vapor stream fed to a feed stage for the depropanizer and a liquid sidedraw is withdrawn from at or near that feed stage such that the liquid sidedraw is fed to the top stage of the butanes distributor column to provide reflux.

5. The process of claim 4 wherein the overhead stream from the normal butane distributor column is fed to a second deisobutanizer and the bottoms stream from the normal butane distributor column is fed to a debutanizer.

6. The process of claim 5 wherein:

(a) the overhead stream of the butane distributor column is a vapor stream and is fed to a feed stage of the second deisobutanizer;

(b) a liquid sidedraw is withdrawn from at or near the feed stage of the second deisobutanizer such that the liquid sidedraw is fed to the top stage of the normal butane distributor column to provide reflux;

(c) the bottoms stream of the normal butane distributor column is fed to a feed stage of the debutanizer;

(d) a vapor sidedraw is withdrawn at or near the feed stage of the debutanizer and fed to the bottom stage of the normal butane distributor column to provide reboiling duty;

(e) an overhead stream of the debutanizer is a vapor stream fed to the bottom stage of the second deisobutanizer to provide reflux; and (f) a bottoms stream from the second deisobutanizer comprises a liquid stream, part of which is fed to the top stage of the debutanizer to provide reflux.

7. The process of claim 6 wherein the pressure of the second deisobutanizer is effectively higher than that of the first deisobutanizer to cause the condensation temperatures of an overhead stream from the second deisobutanizer to be effectively higher than temperatures necessary for reboiling the first deisobutanizer.

8. The process of claim 7 wherein an overhead stream of vapor from the second deisobutanizer comprises the reflux and overhead liquid product flows which are condensed in a reboiler for the first deisobutanizer.

9. The process of claim 4 wherein a sidedraw is withdrawn from the normal butane distributor column comprising mixed butanes and fed to a stage of the first deisobutanizer lower in the column than the stage at which the sidedraw from the depropanizer is fed to the first deisobutanizer.

10. The process of claim 9 wherein the overhead stream of the normal butane distributor column comprises product specification isobutane.

11. The process of claim 10 wherein a bottoms stream of the normal butane distributor column is fed to a debutanizer.

12. The process of claim 11 wherein an overhead stream of the debutanizer is vapor and is fed to the bottom stage of the second deisobutanizer and a part of the bottom stream of the second deisobutanizer is fed to the top stage of the debutanizer to provide reflux.

13. The process of claim 4 wherein the butanes distributor column is interreboiled with one or more interreboilers.

14. The process of claim 4 wherein the overhead stream of the butanes distributor column is depropanized in a depropanizer wherein the depropanizer produces a bottoms stream fed to the top stage of the normal butane distributor column to provide reflux.

15. The process of claim 14 wherein a vapor portion of the overhead stream of the normal butane distributor column is fed to the bottom stage of the depropanizer to provide reboiling duty.

16. The process of claim 15 wherein a liquid sidedraw withdrawn at or near a feed stage of the depropanizer is fed to the top stage of the butanes distributor column to provide reflux.

17. The process of claim 16 wherein a vapor sidedraw withdrawn at or near a feed stage of the normal butane distributor column is fed the to bottom stage of the butanes distributor column to provide reboiling duty.

18. The process of claim 17 wherein at least a portion of the overhead stream of the normal butane distributor column is fed to the first deisobutanizer.

19. The process of claim 17 wherein at least a portion of the overhead stream of the normal butane distributor is further split into two parts, wherein a one part is fed to the first deisobutanizer and a the second part is fed to a second deisobutanizer.

20. The process of claim 19 wherein the first deisobutanizer operates at a significantly lower pressure than the second deisobutanizer.

21. The process of claim 20 wherein the first deisobutanizer further comprises a reboiler whose duty is a least in part supplied by condensing a vapor for refluxing and forming a liquid overhead product stream for the second deisobutanizer.

22. The process of claim 21 wherein the first deisobutanizer produces a bottoms stream comprising product specification normal butane.

23. The process of claim 22 wherein a debutanizer is fed with a bottoms stream from the normal butane distributor column, the debutanizer produces an overhead stream fed to the bottom stage of the second deisobutanizer to supply reboiling duty, and at least a part of a bottom stream from the second deisobutanizer is fed to the top stage of the debutanizer to supply reflux.

24. The process of claim 23 wherein the butanes distributor column, the depropanizer, and the normal butane distributor column operate at about 200 to 300 psia, the debutanizer and the second deisobutanizer operate at about 100 to 200 psia, the first deisobutanizer operates at about 50 to 100 psia.

25. The process of claim 24 wherein the butanes distribution column is interreboiled with one or more interreboilers.

26. The process of claim 25 wherein the debutanizer is interreboiled by an interreboiler.

27. A process for NGL fractionation comprising:

(a) a deethanized NGL stream comprising primarily propane, isobutane, normal butane and gasoline range components;

(b) separating the NGL stream in a depropanizer to overhead, rectification section sidedraw and bottoms streams so that:

(i) substantially all the propane and gasoline components of the NGL stream are separated to the overhead and bottoms streams, respectively, such that a product specification propane stream comprises the overhead stream; and (ii) substantial amounts of both isobutane and normal butane are separated to the rectification section sidedraw and bottoms streams;

(c) further separating the bottoms stream of the depropanizer in a debutanizer to overhead, upper liquid sidedraw, lower vapor sidedraw and bottoms streams so that:

(i) substantially all the isobutane and gasoline components of the bottoms stream of the debutanizer are separated to the overhead and bottoms streams, respectively; and (ii) substantial amounts of normal butane are separated to the overhead, upper liquid sidedraw, and lower vapor sidedraw streams of the normal butane distributor column.

28. The process of claim 27 wherein the rectification section sidedraw stream of the depropanizer is fed to the top stage of a sidestripper and an overhead vapor stream of the sidestripper is returned to the withdrawal stage of the rectification section sidedraw stream.

29. The process of claim 28 wherein a bottoms stream of the sidestripper comprises product specification normal butane.

30. The process of claim 29 wherein a sidedraw is withdrawn from the sidestripper and fed to an upper feed stage of a deisobutanizer and an overhead stream of the debutanizer is fed to a lower feed stage of the deisobutanizer.

31. The process of claim 30 wherein the upper liquid sidedraw of the debutanizer is fed to the top stage of a side column, which produces an overhead vapor stream which is returned to the withdrawal stage of the upper liquid sidedraw of the debutanizer, and wherein the lower vapor sidedraw is fed to the bottom stage of the side column, which also produces a bottom stream which is fed to the withdrawal stage of the lower vapor sidedraw of the debutanizer.

32. The process of claim 31 wherein a sidedraw is withdrawn from the side column comprising product quality normal butane.

33. The process of claim 32 wherein the deisobutanizer produces an overhead stream comprising product specification isobutane and a bottom stream comprising product quality normal butane.

34. The process of claim 33 wherein the pressure of the debutanizer is effectively higher than that of the deisobutanizer to cause the condensation temperatures of an overhead stream from the debutanizer to be higher than temperatures necessary for reboiling the deisobutanizer.

35. The process of claim 34 wherein an overhead stream of vapor from the debutanizer comprises the reflux and overhead liquid product flows which are condensed in a reboiler for the deisobutanizer.

* * * * *